US005455668A

United States Patent [19]

De Bock et al.

[11] Patent Number: 5,455,668

[45] Date of Patent: Oct. 3, 1995

[54] ELECTROSTATOGRAPHIC SINGLE-PASS MULTIPLE-STATION PRINTER FOR FORMING AN IMAGE ON A WEB

[75] Inventors: Jan J. I. De Bock, Beveren; Etienne M. De Cock; Lucien A. De Schamphelaere, both of Edegem; Rudy D. Leroy, Mechelen, all of Belgium

[73] Assignee: Xeikon NV, Mortsel, Belgium

[21] Appl. No.: 257,112

[22] Filed: Jun. 8, 1994

[30] Foreign Application Priority Data

Jun. 18, 1993 [EP] European Pat. Off. ..... 93304771
May 4, 1994 [EP] European Pat. Off. ..... 94302399

[51] Int. Cl.[6] ..... G03G 15/01

[52] U.S. Cl. ..... 355/326 R; 355/309; 355/317

[58] Field of Search ..... 355/308–310, 355/317, 321, 326 R, 327; 101/180

[56] References Cited

U.S. PATENT DOCUMENTS

| | | | |
|---|---|---|---|
| 3,694,073 | 9/1972 | Bhagat | 355/210 |
| 3,893,800 | 7/1975 | Wako | 432/60 |
| 5,274,428 | 12/1993 | Wong et al. | 355/326 R |
| 5,331,890 | 7/1994 | Miyoshi et al. | 101/180 X |

FOREIGN PATENT DOCUMENTS

| | | |
|---|---|---|
| 0342366 | 11/1989 | European Pat. Off. . |
| 0491087 | 6/1992 | European Pat. Off. . |

OTHER PUBLICATIONS

"Color Image–Forming Apparatus"; Research Disclosure, Sep. 1991, No. 329 p. 680.

"Color Xerography With Intermediate Transfer" by J. R. Davidson, Xerox Disclosure Journal, vol. 1, No. 7, Jul. 1976, p. 29.

*Primary Examiner*—William J. Royer

*Attorney, Agent, or Firm*—Brumbaugh, Graves, Donohue & Raymond

[57] ABSTRACT

An electrostatographic single-pass multiple station multicolor printer for forming an image onto a web, eg of paper, is described. A plurality of toner image-producing electrostatographic printing stations each have a rotatable endless surface such as the photoconductive surface of a cylindrical drum onto which a toner image can be formed. The paper web is conveyed in succession past the printing stations. The speed and tension of the web is controlled while it is running past the printing stations. Guiding rollers which determine for the web wrapping angles of about 15° about the drum surface. A corona device transfers the toner image on each drum onto the web. The corona device, the wrapping angles ω and the web tension are such that adherent contact of the web with the drum surface is such that the moving paper web controls the peripheral speed of the drum in synchronism with the movement of the web. Slippage between the drum surface and the paper web is thereby eliminated, enabling accurate registration of superimposed images on the paper web.

21 Claims, 25 Drawing Sheets

Fig. 6-1
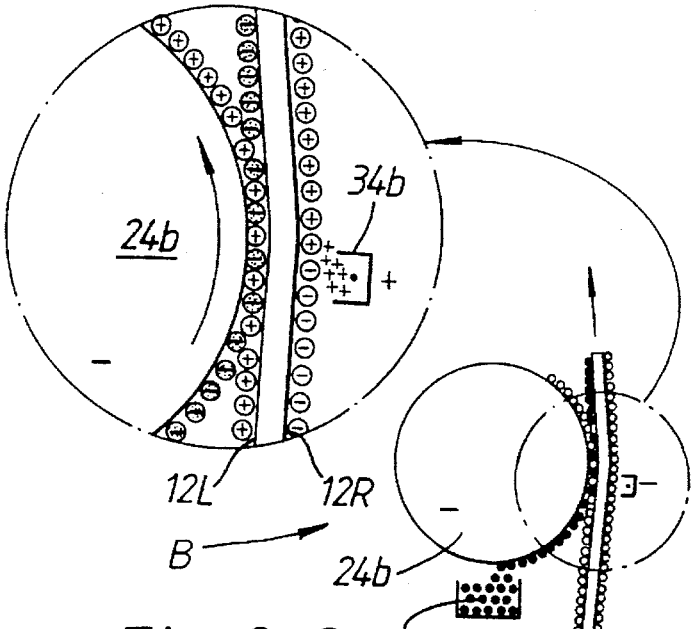
Fig. 6-2
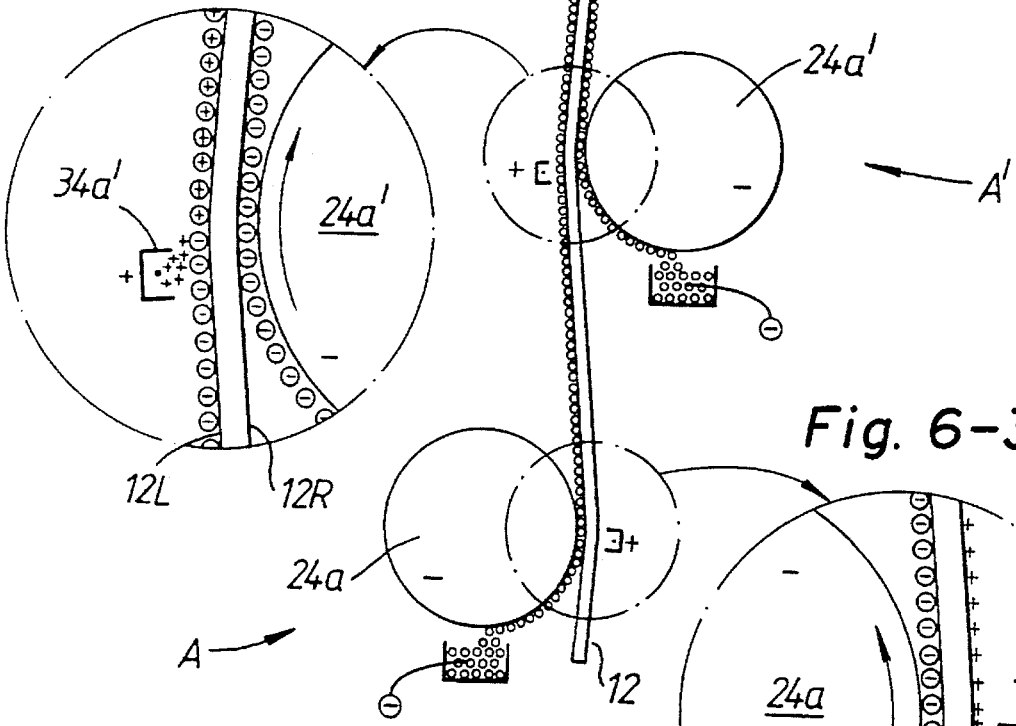
Fig. 6-3
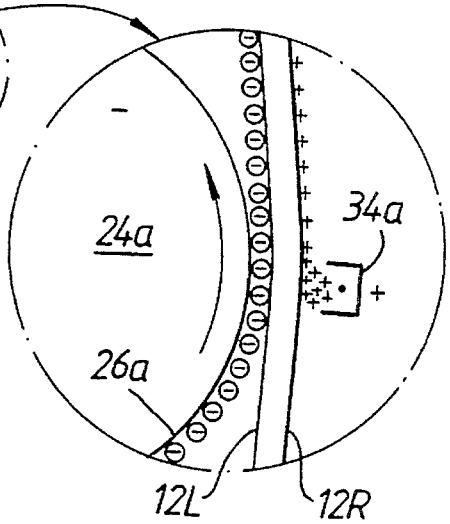
Fig.6

Fig. 6B-1
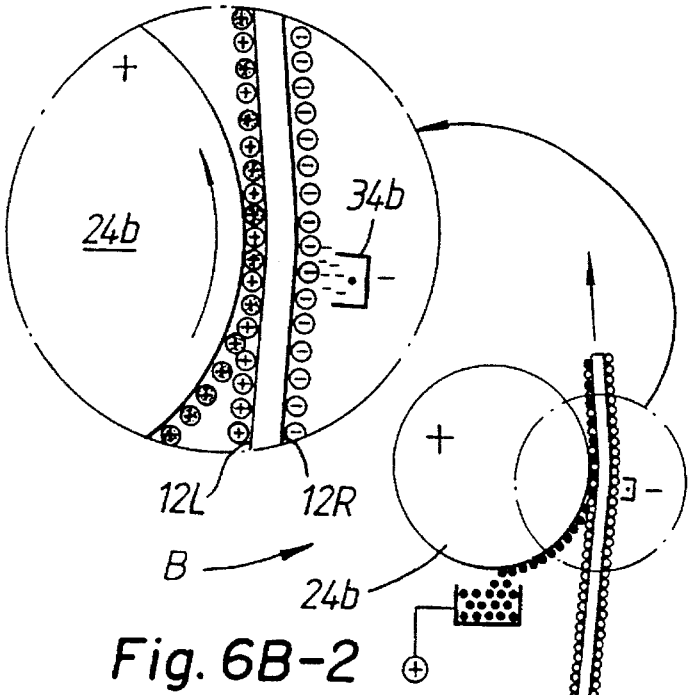
Fig. 6B-2
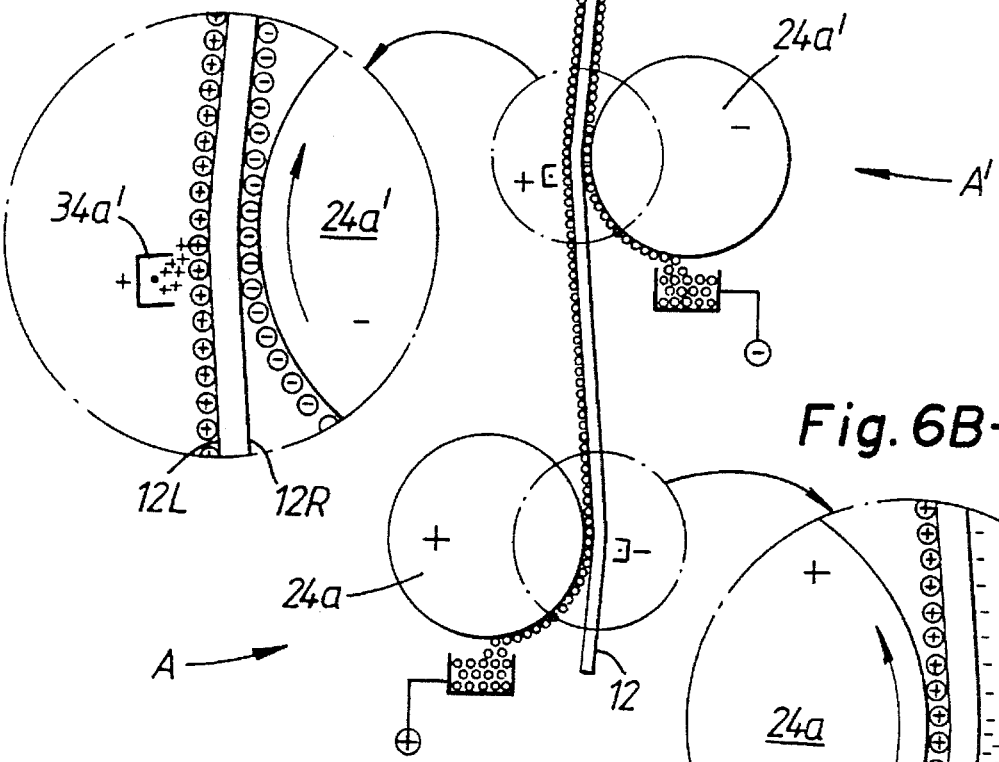
Fig. 6B-3
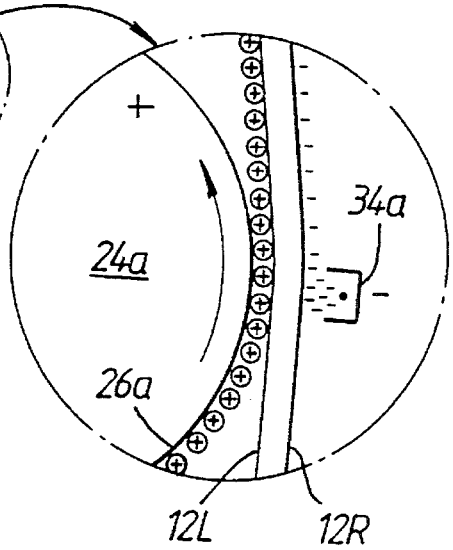
Fig.6B

Fig. 7A-1
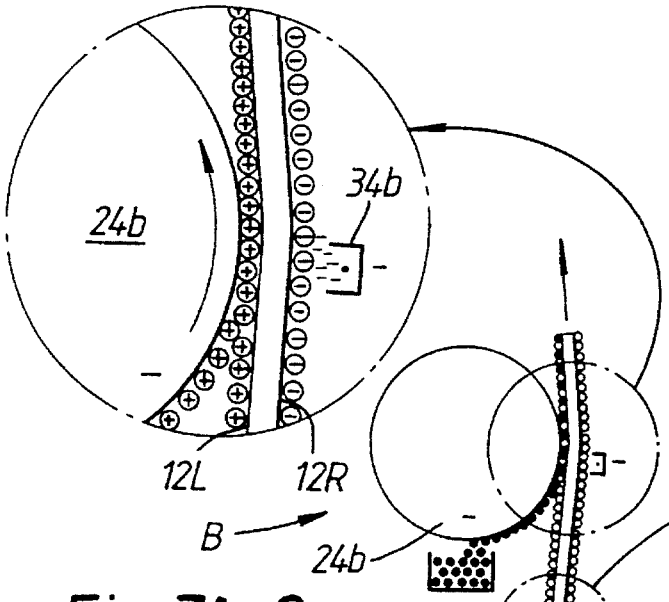
Fig. 7A-3
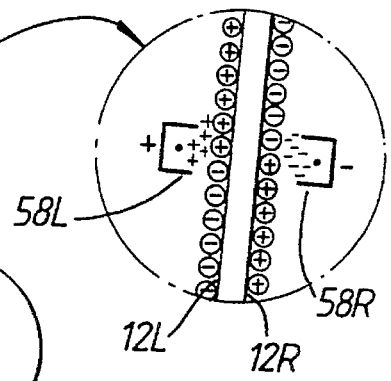
Fig. 7A-2
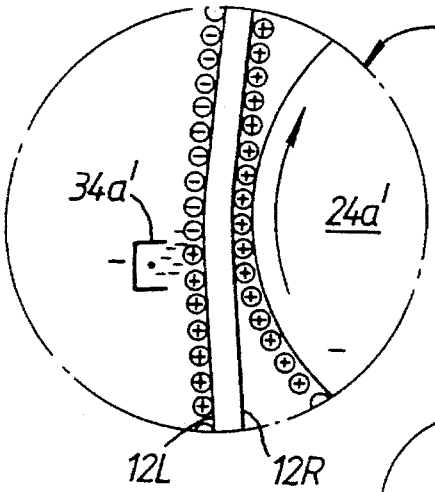
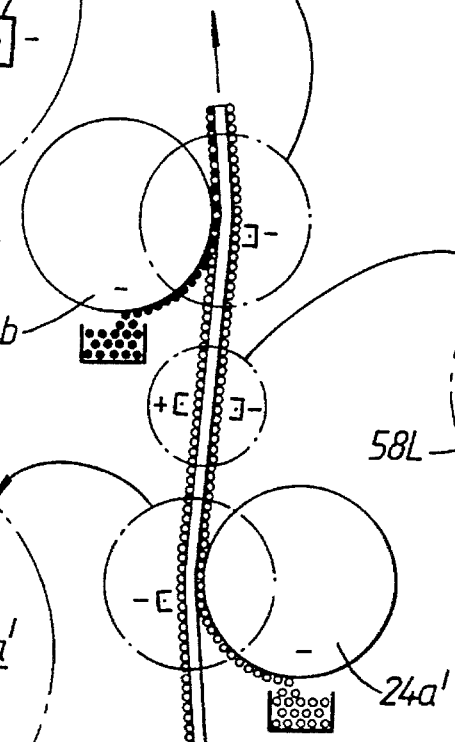
Fig. 7A-4
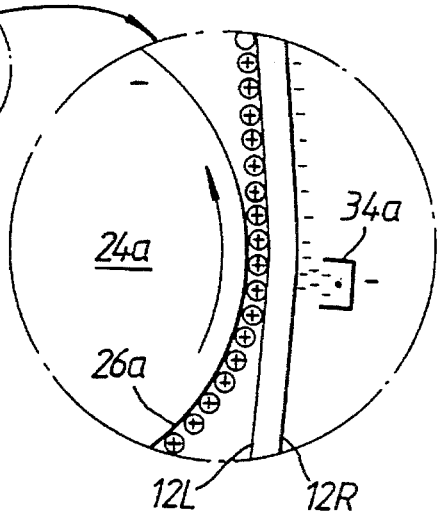
Fig. 7A

ELECTROSTATOGRAPHIC SINGLE-PASS MULTIPLE-STATION PRINTER FOR FORMING AN IMAGE ON A WEB

FIELD OF THE INVENTION

This invention relates to an electrostatographic single-pass multiple station (for example multi-colour) printer, in particular such a printer as is capable of printing colour images for professional purposes as a cost effective alternative to conventional printing of short to medium sized runs.

BACKGROUND OF THE INVENTION

Electrostatographic printing operates according to the principles and embodiments of non-impact printing as described, eg, in "Principles of Non-Impact Printing" by Jerome L Johnson (1986)—Palatino Press—Irvine Calif., 92715 USA).

Electrostatographic printing includes electrographic printing in which an electrostatic charge is deposited image-wise on a dielectric recording member as well as electrophotographic printing in which an overall electrostatically charged photoconductive dielectric recording member is image-wise exposed to conductivity increasing radiation producing thereby a "direct" or "reversal" toner-developable charge pattern on said recording member. "Direct" development is a positive-positive development, and is particularly useful for reproducing pictures and text. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (eg printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, ie computer stored information.

As used herein, the term "electrostatographic" also includes the direct image-wise application of electrostatic charges on an insulating support, for example by ionography.

In the electrophotographic art, an electrostatographic single-pass multiple station multi-colour printer is known, in which an image is formed on a photoconductive belt and is then transferred to a paper receiving sheet or web whereon the toner image is fixed, whereupon the web is usually cut into sheets containing the desired print frame.

In an alternative printer, toner images are transferred to an insulating belt from distinct image forming stations and are then transferred to the receiving sheet or web and fixed thereon. In U.S. Pat. No. 5160946 (Hwang assigned to Xerox Corporation) there is described an electrophotographic printing machine in which a plurality of image-forming units are arranged to superimpose toner images onto a motor-driven endless belt, from which the superimposed image is transferred to a paper sheet. Each image-forming unit includes a rotatable drum driven by a motor (see column 5, lines 22 to 27) in synchronism with the endless belt.

It is desirable to transfer a plurality of toner images in succession, that is in a single pass through the printer, directly onto the receiving web. In order to achieve this, accurate registration of the images with each other is required, ideally to an accuracy of about 40 μm, or better. In order to achieve this registration accuracy, it is essential that there should be no slippage, ie synchronism, between the web and the image bearing surface. When, for example, a number of rotatable drums are driven by individual motors, it is found in practice to be difficult to obtain perfect synchronous movement between the drums and the receiving web—resulting in registration errors.

SUMMARY OF THE INVENTION

It is an object of the present invention to provide an electrostatographic single-pass multiple station printer in which the registration problems and the problem of synchronism (no slippage) between the web and the image-bearing surface are solved.

According to the present invention there is provided an electrostatographic single-pass multiple station printer for forming an image onto a web, which comprises:

- a plurality of toner image-producing electrostatographic stations each having rotatable endless surface means onto which a toner image can be formed;
- means for conveying the web in succession past said stations;
- means for controlling the speed and tension of the web while it is running past said stations;
- guiding means which determine for the web wrapping angles about the rotatable surface means;
- transfer means for transferring the toner image on each rotatable surface means onto the web, characterised in that in said printer adherent contact of said web with said rotatable endless surface means is such that the movement of said web controls the peripheral speed of said surface means in synchronism with the movement of the web.

By stating that the adherent contact of the web with said rotatable endless surface means is such that the moving web controls the peripheral speed of said surface means, we mean that the only rotational torque, or substantially the only rotational torque, which is applied to said endless surface means is derived from the adherent contact between the web and the endless surface means. As explained further below, since no other, or substantially no other, resultant force is acting upon the endless surface means, the endless surface means is constrained to rotate in synchronism with the moving web.

While the toner image on the endless surface means may be transferred to the web by other means, such as an opposed hot roller or pressure roller, we prefer to use a corona discharge device as the transfer means. This has the advantage that, at least partly, the adherent contact between the web and the endless surface means comes from the transfer corona discharge device providing electrostatic adhesion between the web and the endless surface means.

According to the present invention said adherent contact results also from a mechanical contact obtained by guiding and tensioning said web over a certain wrapping angle in contact with said rotatable endless surface means.

Usually, the rotatable endless surface means comprises a belt or the circumferential surface of a drum. In the following general description, reference is made to a drum, but it is to be understood that such references are also applicable to endless belts or to any other form of endless surface means. The toner image can be generated on the surface of a first drum and then transferred to the surface of a second drum, so that the second drum acts as an intermediate member, such as described in Offset Quality Electrophotography by L B Schein & G Beardsley, Journal of Imaging Science and Technology, Vol. 37, No. 5(1993),—see page 459. However, we prefer that the toner image is formed directly on the surface of a drum. To this end, the drum preferably has a photoconductive surface and each toner image-producing electrostatographic station preferably comprises means for charging the surface of the drum, and usually the surface of the drums at all the image-producing stations are charged to the same polarity. Using photoconductors of the organic type, it is most convenient to charge the surface of the drums to a negative polarity and to develop the latent image formed thereon in reversal development mode by the use of a negatively charged toner.

The means for image-wise exposing the charged surface of the drum or belt may comprise an array of image-wise modulated light-emitting diodes or take the form of a scanning laser beam.

The toner will usually be in dry particulate form, but the invention is equally applicable where the toner particles are present as a dispersion in a liquid carrier medium or in a gas medium in the form of an aerosol.

It is convenient for each image-producing station to comprise a driven rotatable magnetic developing brush and a driven rotatable cleaning brush, both in frictional contact with the drum surface. We have found that by arranging for the developing brush and the cleaning brush to rotate in opposite senses, it can be assured that the resultant torque applied by the brushes to the drum surface is at least partly cancelled out. In particular, we prefer that the extents of frictional contact of the developing brush and of the cleaning brush with the drum surface are such that the resultant torque transmitted to the drum surface is substantially zero. By stating that the resultant torque transmitted to the drum surface is substantially zero is meant that any resultant torque acting upon the drum surface is smaller than the torque applied by the web to the drum surface.

To achieve this in a practical manner, the position and/or the speed of at least one of said brushes relative to the drum surface may be adjustable thereby to adjust the extent of frictional contact between that brush and the drum surface.

In one embodiment of the invention, the web is a final support for the toner images and is unwound from a roll, fixing means being provided for fixing the transferred images on the web. In this embodiment, the printer may further comprise a roll stand for unwinding a roll of web to be printed in the printer, and a web cutter for cutting the printed web into sheets. The drive means for the web may comprise one or more drive rollers, preferably at least one drive roller being positioned downstream of the image-producing stations and a brake or at least one drive roller being positioned upstream of the image forming stations. The speed of the web through the printer and the tension therein is dependent upon the speed and the torque applied to these drive rollers.

For example, one may provide two motor driven drive rollers, one driven at a constant speed defining the web speed and the other driven at constant torque defining the web tension. Preferably the web is conveyed through the printer at a speed of from 5 cm/sec to 50 cm/sec and the tension in the web at each image-producing station preferably lies within the range of 0.2 to 2.0 N/cm web width.

In an alternative embodiment of the invention, the web is a temporary support in the form of a tensioned endless belt, and the printer further comprises transfer means for transferring the images formed on the belt onto a final support, fixing means being provided for fixing the transferred images on the final support. In this embodiment, the final support may be in web or sheet form.

The adherent contact mentioned hereinbefore is obtained at least partly by guiding means, for example freely rotating rollers, positioned to define a wrapping angle with respect to the rotatable surface means, preferably a wrapping angle of at least 5°, preferably from 10° to 20°. The use of the optimum wrapping angle is important, not only for ensuring that the movement of the web controls the peripheral speed of the drum in synchronism therewith, but also to improve the quality of image transfer from the drum surface to the web by avoiding jumping of toner particles from the drum surface to the web which would be liable to occur in the case of tangential contact between the web and the drum, and which could result in a loss of image quality. The wrapping angle should also preferably be sufficient that, where a corona device is used as the transfer means, the web is in contact with the drum over the whole width of the flux angle of the transfer corona. The guiding means contacts the web on the side thereof opposite to that on which the toner images are transferred. The guiding means are preferably guiding rollers but may, for example, alternatively be formed by stationary air-bearings.

As a possible embodiment, the image-producing stations are so disposed in relationship to one another that they are arranged along the arc of a circle. However, such an arrangement is more complicated to construct and we therefore prefer an arrangement in which image-producing stations are disposed substantially in a straight line.

The transfer means is in the form of a corona discharge device which sprays charged particles having a charge opposite to that of the toner particles. The supply current fed to the corona discharge device is preferably within the range of 1 to 10 μA/cm web width, most preferably from 2 to 5 μA/cm web width, depending upon the paper characteristics and will be positioned at a distance of from 3 mm to 10 mm from the path of the web.

It is possible for the stations to be arranged in two sub-groups, one sub-group forming an image on one web side and the other sub-group forming an image on the other web side, thereby to enable duplex printing. In one such arrangement, the stations are arranged in two sub-groups that are passed in succession by the moving web, thereby to enable sequential duplex printing. To enable this to be achieved, the printer may further comprise at least one idler roller for reversing the direction of web travel between the sub-groups. This enables the web to be fed from the first sub-group of stations to the second sub-group of stations. If, in such an arrangement, it would be necessary for the web to pass over direction-reversing rollers in such a manner that the side of the web carrying the image transferred in the first sub-group of stations would be in contact with the surface of the direction-reversing rollers, it is of advantage to position a first image-fixing station between the sub-groups of stations to fix the first formed image before such contact occurs.

In a floor space-saving arrangement, the stations of the sub-groups are arranged in a substantially mutually parallel configuration and in particular the stations of each sub-group are arranged in a substantially vertical configuration.

In a preferred embodiment of the invention, the stations are arranged in two sub-groups, the drums of one sub-group forming the guide roller means for the other sub-group, and vice-versa, to define the wrapping angle of the web at adjacent image producing stations, thereby to enable simultaneous duplex printing. In such an embodiment, image(s) are transferred to a first side of the web by one or more image-producing stations, image(s) are then transferred to the opposite side of the web by one or more further image-producing stations and thereafter further image(s) are formed on the first side of the web again by one or more still further image-producing stations. Such an arrangement is referred to as a "staggered" arrangement and the most preferred embodiment of a staggered arrangement is where the image-producing stations are located one by one alternately on opposite sides of the web.

The printer construction according to the invention is particularly advantageous where the printer is a multi-colour printer comprising magenta, cyan, yellow and black printing stations.

In duplex printing on web-type material, reversing or turner mechanisms may be desirable for reversing the web and feeding it into a next printing station—see for example "The Printing Industry" by Victor Strauss, published by Printing Industries of America Inc, 20 Chevy Chase Circle, NW, Washington D.C. 20015 (1967), p 512–514. The turnaround of the web to be printed requires an additional turnaround mechanism containing one or more reversing rollers. However, it is difficult to maintain image quality when a toner-laden web comes with one or both of its toner-laden sides into contact with a reversing roller, or other contact roller, before sufficient fixing of the roller-contacting toner image has taken place.

According to preferred embodiments of the invention, we therefore provide the printer with a rotatable contact roller for contacting the web while it has an electrostatically charged toner particle image on at least that surface thereof which is adjacent said contact roller, wherein in that said contact roller is associated with electrostatic charging means capable of providing on the surface of said contact roller an electrostatic charge having the same polarity as the charge polarity of the toner particles on the adjacent surface of said web before contact of said receptor material with the surface of said contact roller.

Thus the quality of a toner image is practically not impaired by contact of the web through its non-fixed or incompletely fixed toner particles with a contact roller surface before complete fixing of the toner image.

We prefer that the contact roller is also associated with cleaning means for removing any toner particles from the surface of said roller after release of the receptor material from the surface of said contact roller.

While this feature of the invention may be applied to a contact roller in the form of a web transport roller, a guiding roller, a cold pressure roller or a hot pressure roller, we have found that this arrangement is particularly beneficially applicable to the contact roller being a reversing roller. Where the contact roller is a reversing roller, the wrapping angle of the web about the roller will be greater than 90°. It is possible for a number of reversing rollers to be provided in series, in which case the total of the wrapping angles about these rollers will be greater than 90°.

The contact roller preferably comprises an electrically insulating surface coating. We prefer that this surface coating is smooth and in particular comprises an abhesive material. When the contact roller has an electrically insulating surface, said electrostatic charging means may suitably comprise a corona charge device arranged for directing its corona flux to the electrically insulating surface of the contact roller, said contact roller being earthed or at a fixed potential with respect to said corona charge device. As an alternative, the electrostatic charging means may be a brush in contact with the contact roller, relative movement between the brush and the roller surface causing the generation of electrostatic charge on the surface of the contact roller.

The cleaning means is preferably located upstream of said charging means, considered in the direction of rotation of the contact roller. The cleaning means may include a cleaning brush capable of rotating in the same rotational sense as the contact roller. A scraper device may alternatively be used as the cleaning means.

A pair of corona charge devices may be located upstream of said contact roller, one on either side of the web path to ensure that the toner particles on opposite sides of the web carry opposite electrostatic charges.

In a preferred construction, a direct current charge corona is arranged for directing its corona charge flux towards the web in the zone wherein the web contacts the surface of the contact roller, and an alternating current corona device is arranged for directing its corona discharge flux towards the web substantially at the position where said web leaves the surface of the contact roller.

Preferred embodiments of the invention

The invention will now be further described, purely by way of example, with reference to the accompanying drawings, in which.

Figure 4:
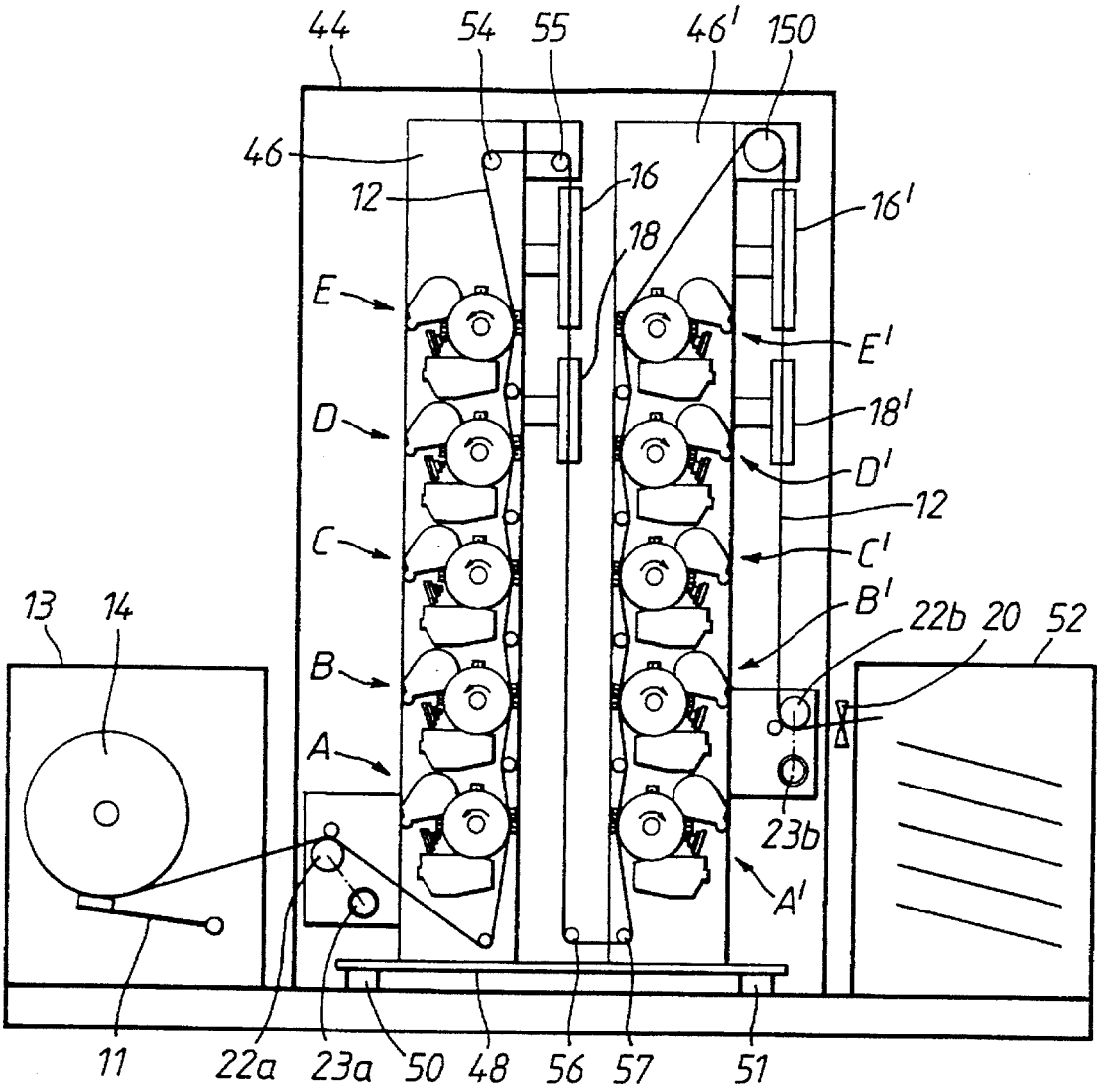
FIG. 4 shows a section of a printer according to an alternative embodiment of the invention capable of sequential duplex printing.
Figure 5:
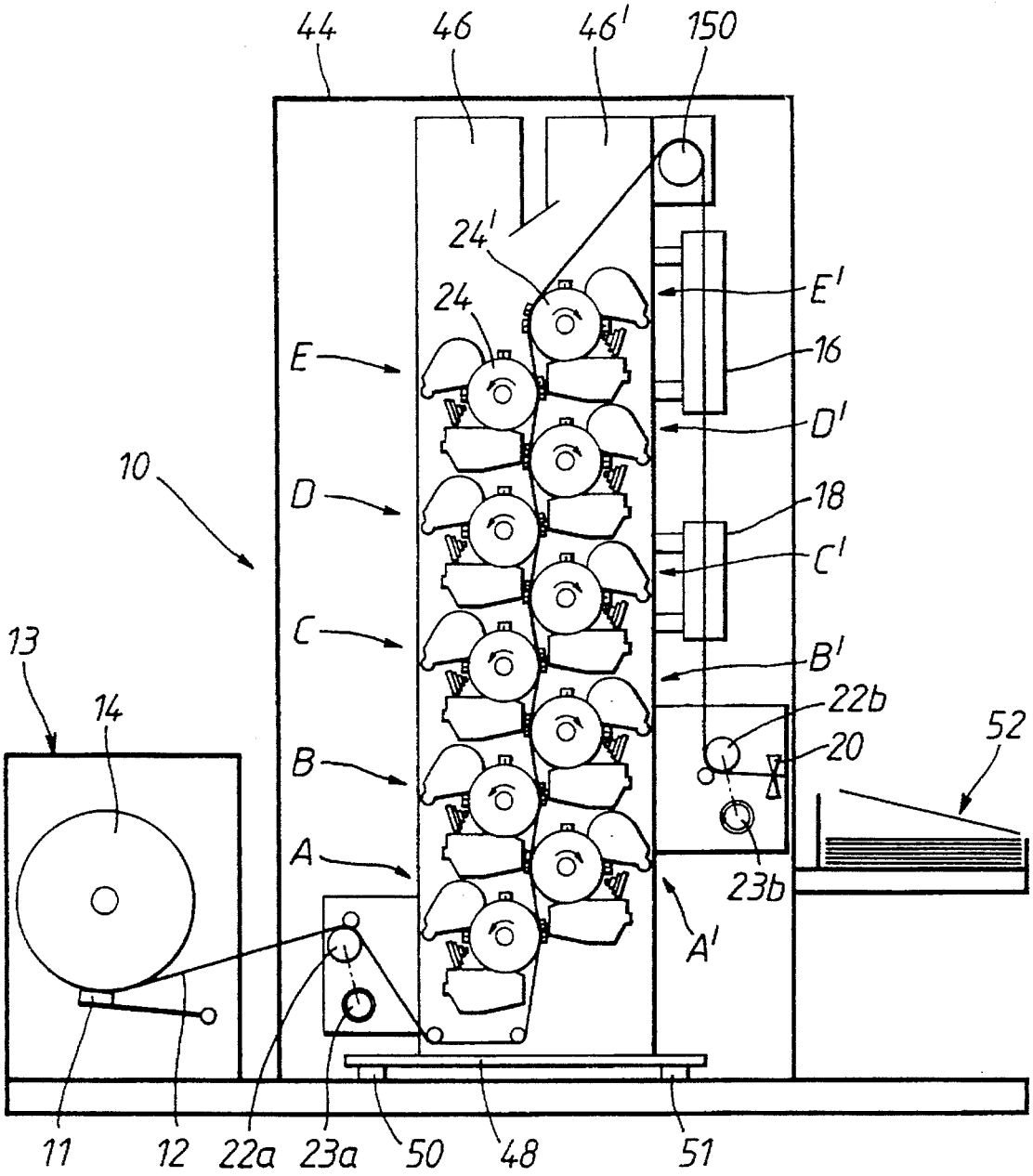
FIG. 5 shows a section of a printer according to an alternative embodiment of the invention, capable of simultaneous duplex printing.
Figures 1, 2, 3, 6A:
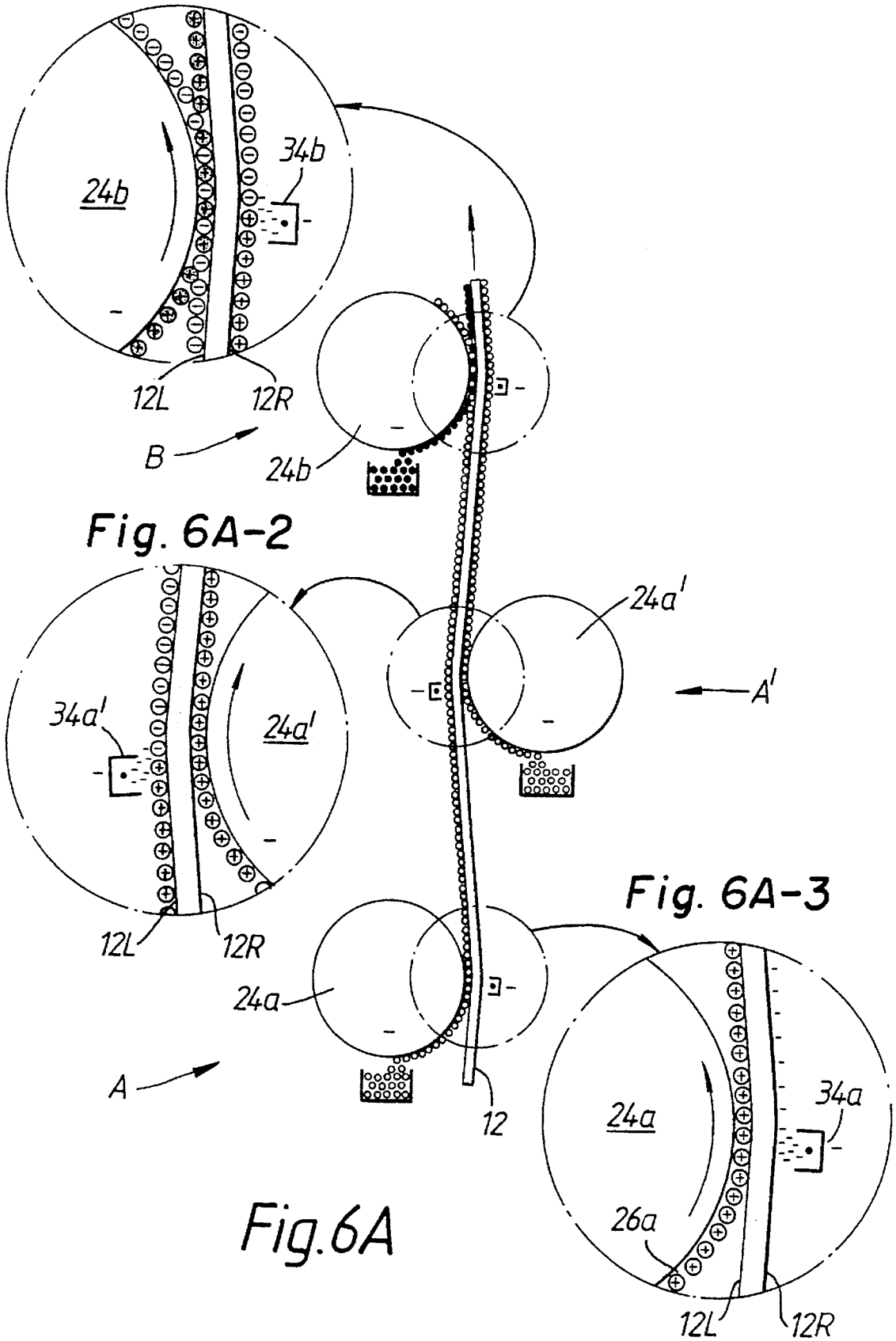
Figures 1, 7:
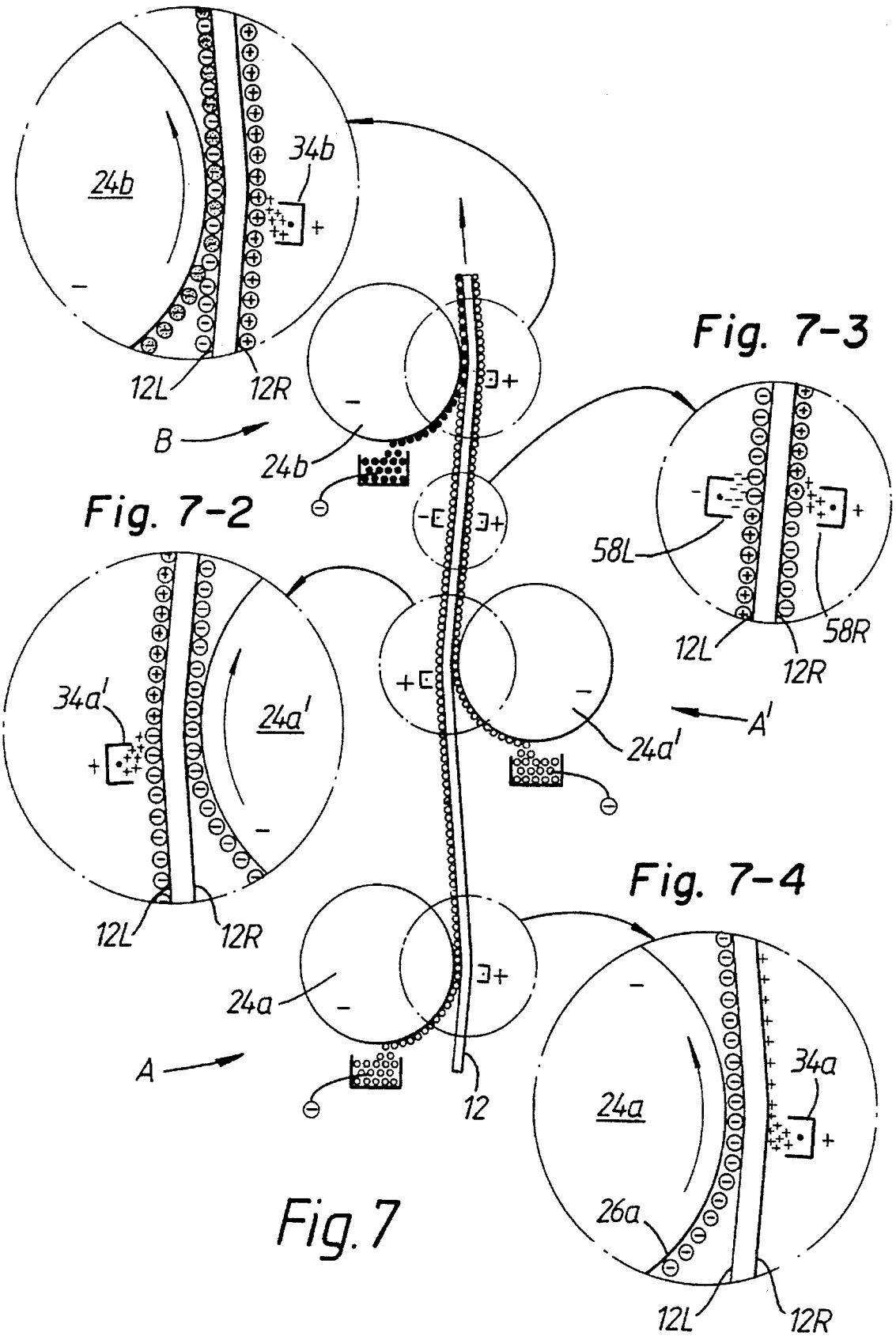

FIGS. 6 and 7 represent diagrammatic cross-sectional views of part of a printer such as that shown in FIG. 5, operating in reversal development mode, these views showing the first three printing stations wherein for comparative purposes FIG. 6 is incomplete. FIGS. 6-1, 6-2, and 6-3 are enlargements of different parts of the portion of the printer shown in FIG. 6. FIGS. 7-1, 7-2, 7-3, and 7-4 are enlargements of different parts of the portion of the printer shown in FIG. 7.

Figure 1:
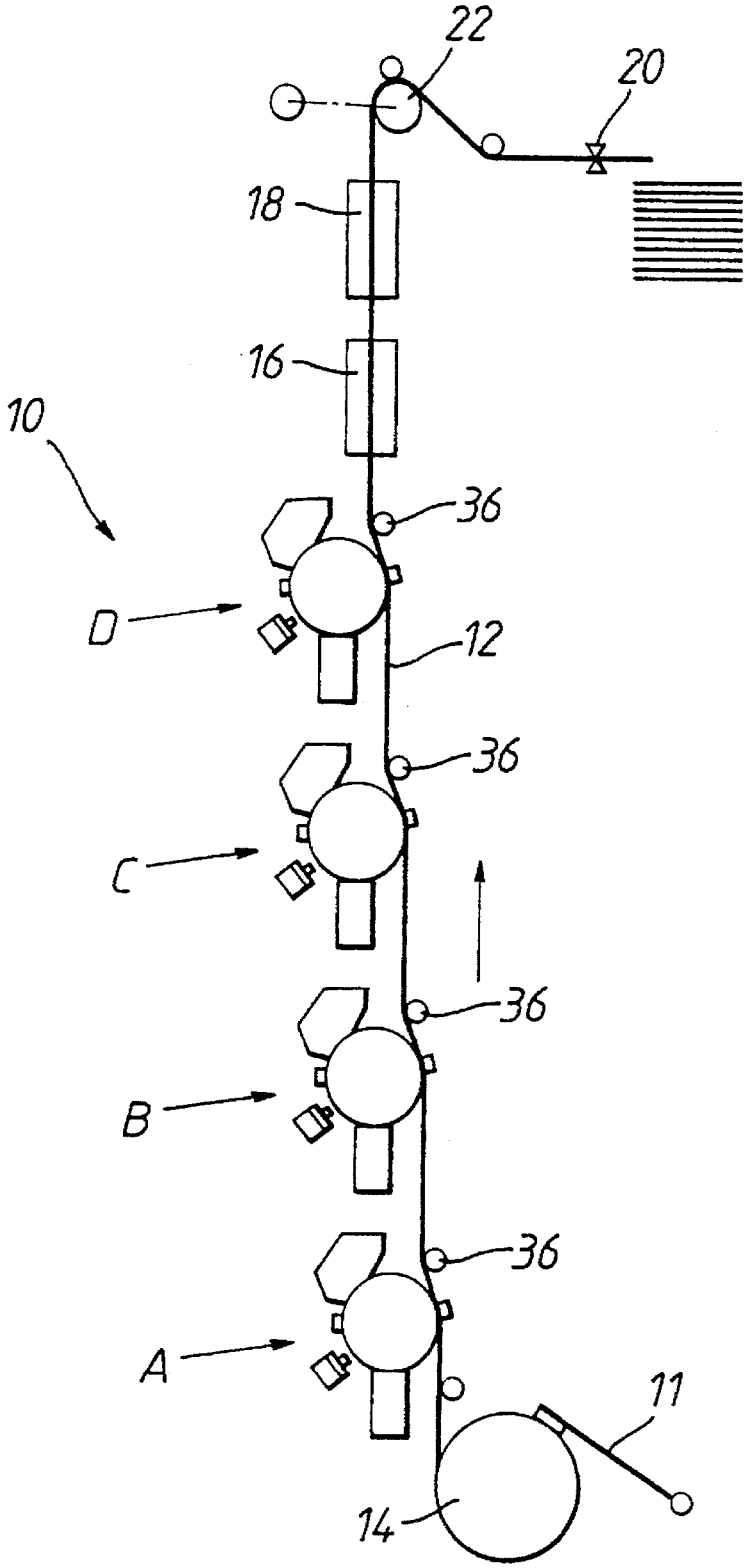
FIG. 1 shows schematically an electrostatographic single-pass multiple station printer according to the invention, suitable for simplex printing.
Figure 8:
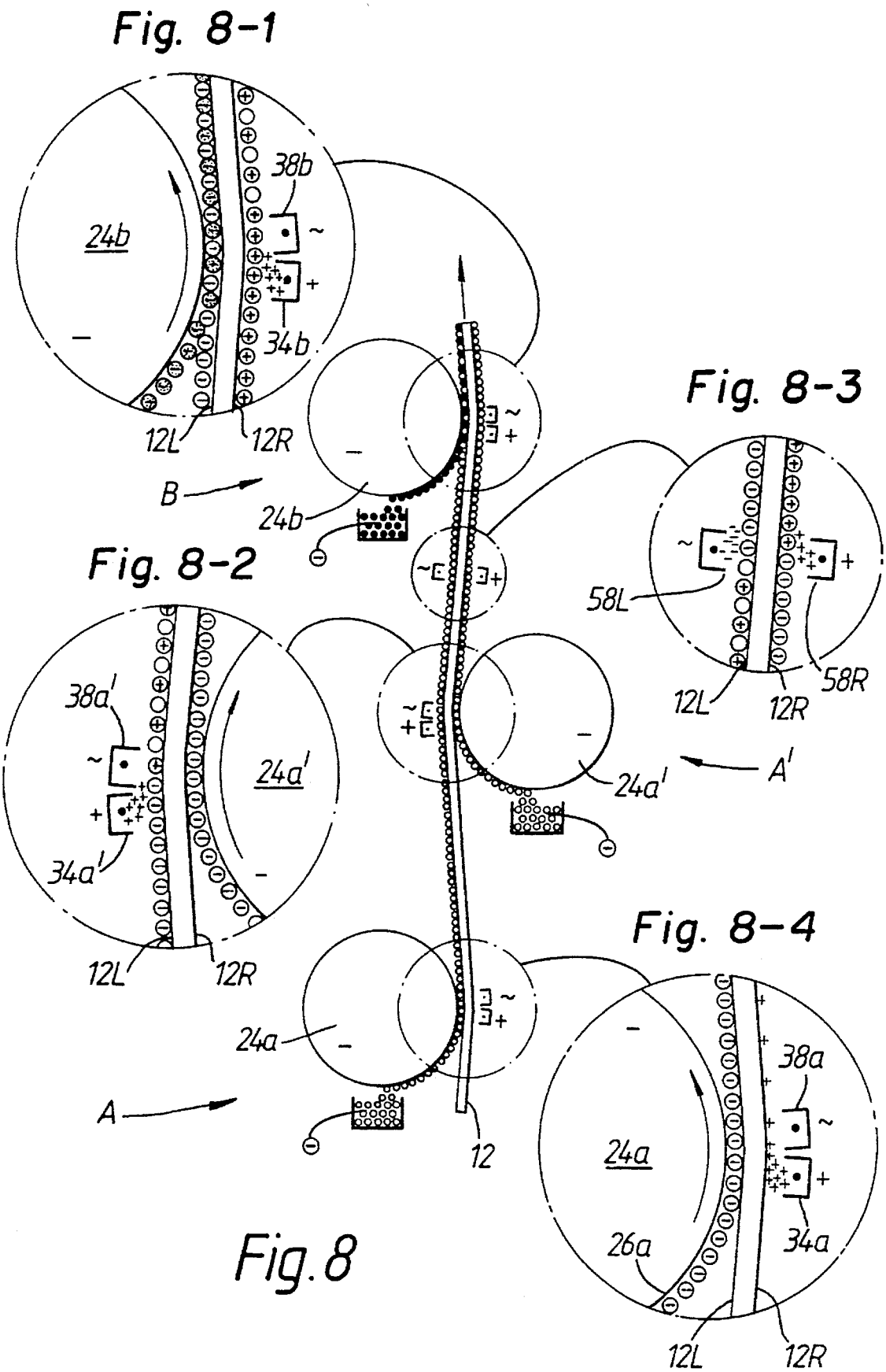
Figure 8A:
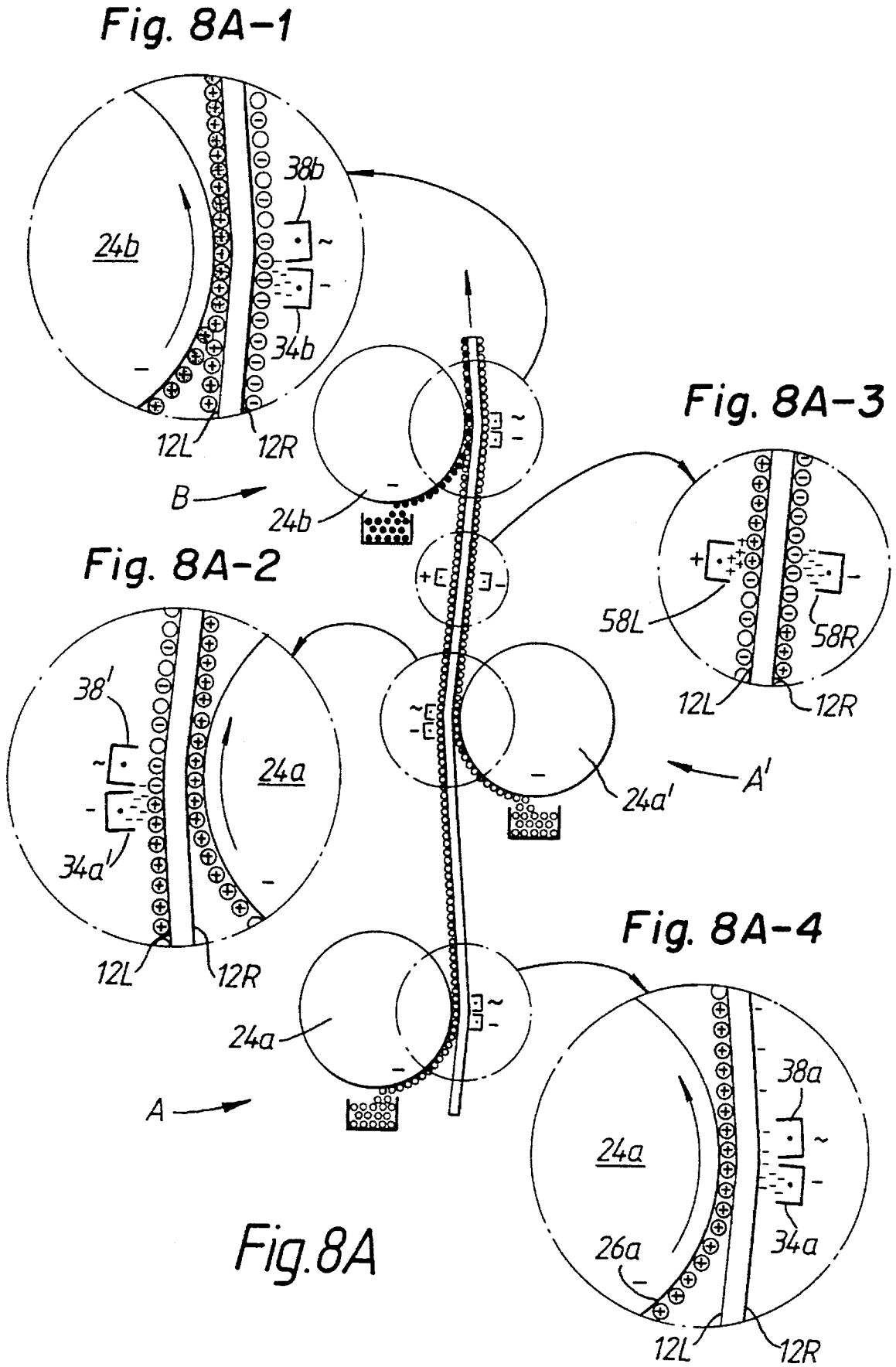

FIGS. 6A, 7A and 8A are similar to FIGS. 6, 7 and 8, but show the printer used in direct development mode. FIGS. 6A-1, 6A-2, and 6A-3 are enlargements of different parts of the portion of the printer shown in FIG. 6A. FIGS. 7A-1, A-2, 7A-3, and 7A-4 are enlargements of different parts of the portion of the printer shown in FIG. 7A. FIGS. 8A-1, 8A-2, 8A-3, and 8A-4 are enlargements of different parts of the portion of the printer shown in FIG. 8A.

FIG. 6B is similar to FIG. 6, but shows the printer utilizing opposite drum and toner polarities at adjacent printing stations. FIGS. 6B-1, 6B-2, and 6B-3 are enlargements of different parts of the portion of the printer shown in FIG. 6B.

FIG. 8 represents a modification of the view shown in FIG. 7.

Figure 9:
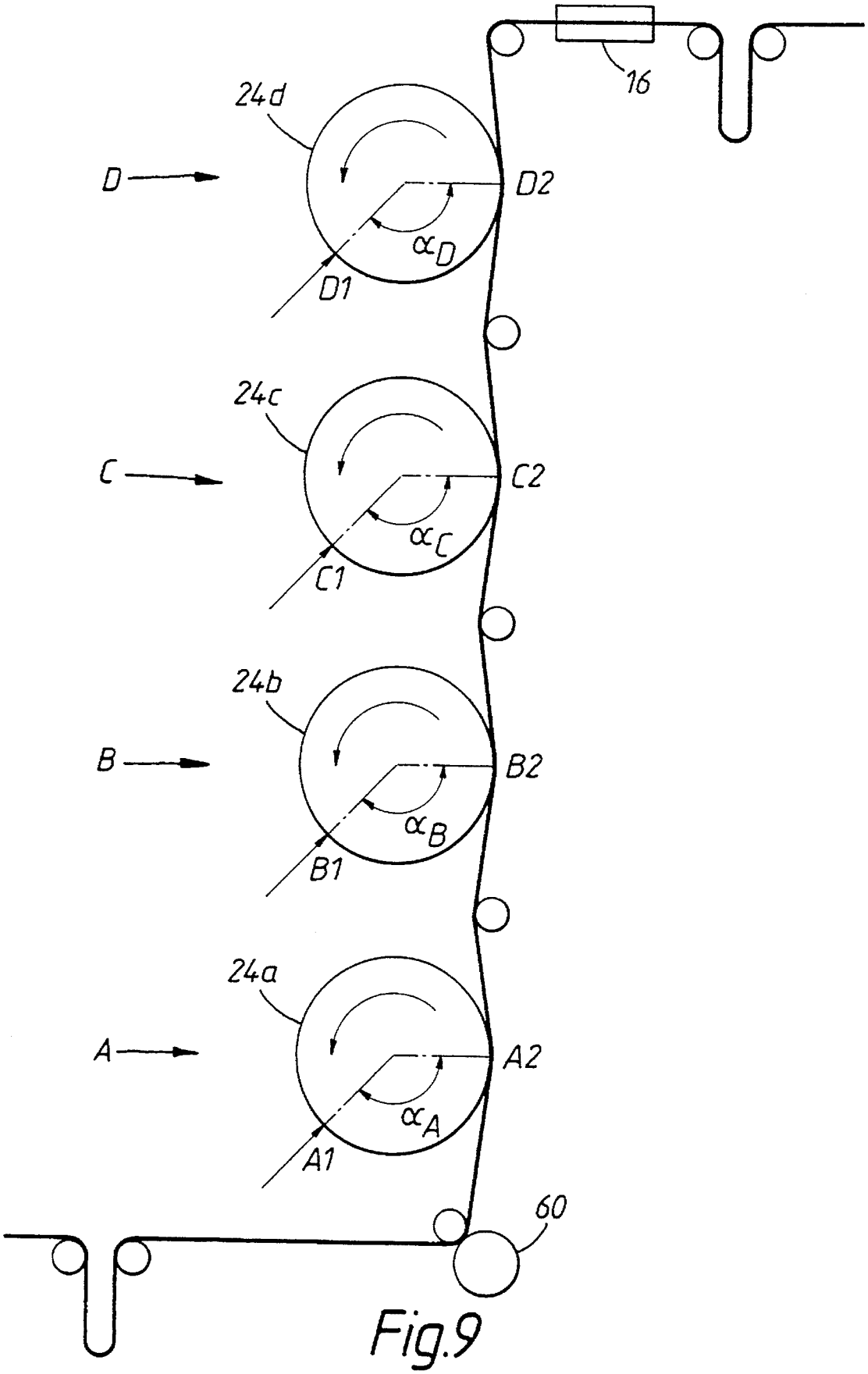

FIG. 9 shows a schematic representation of transferring images in register.

Figure 9A:
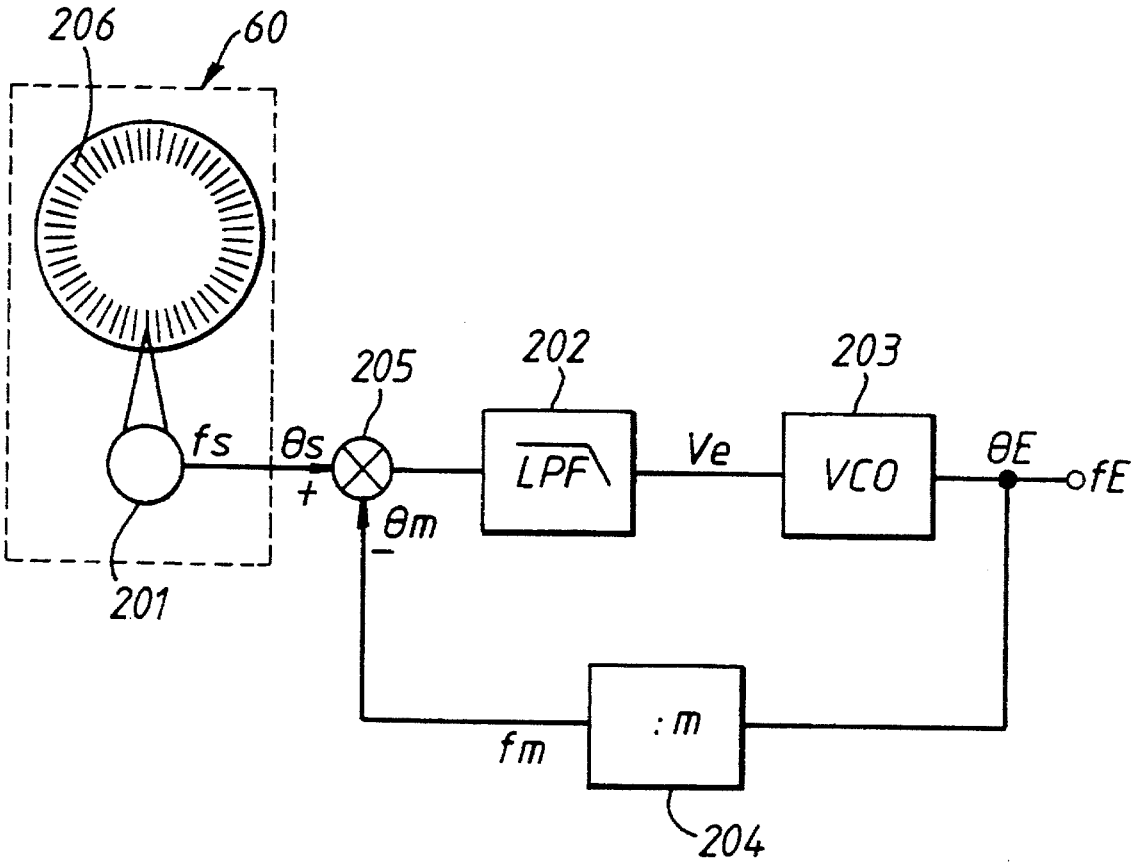

FIG. 9A shows a frequency multiplier circuit for use in a printer according to the invention.

Figure 10:
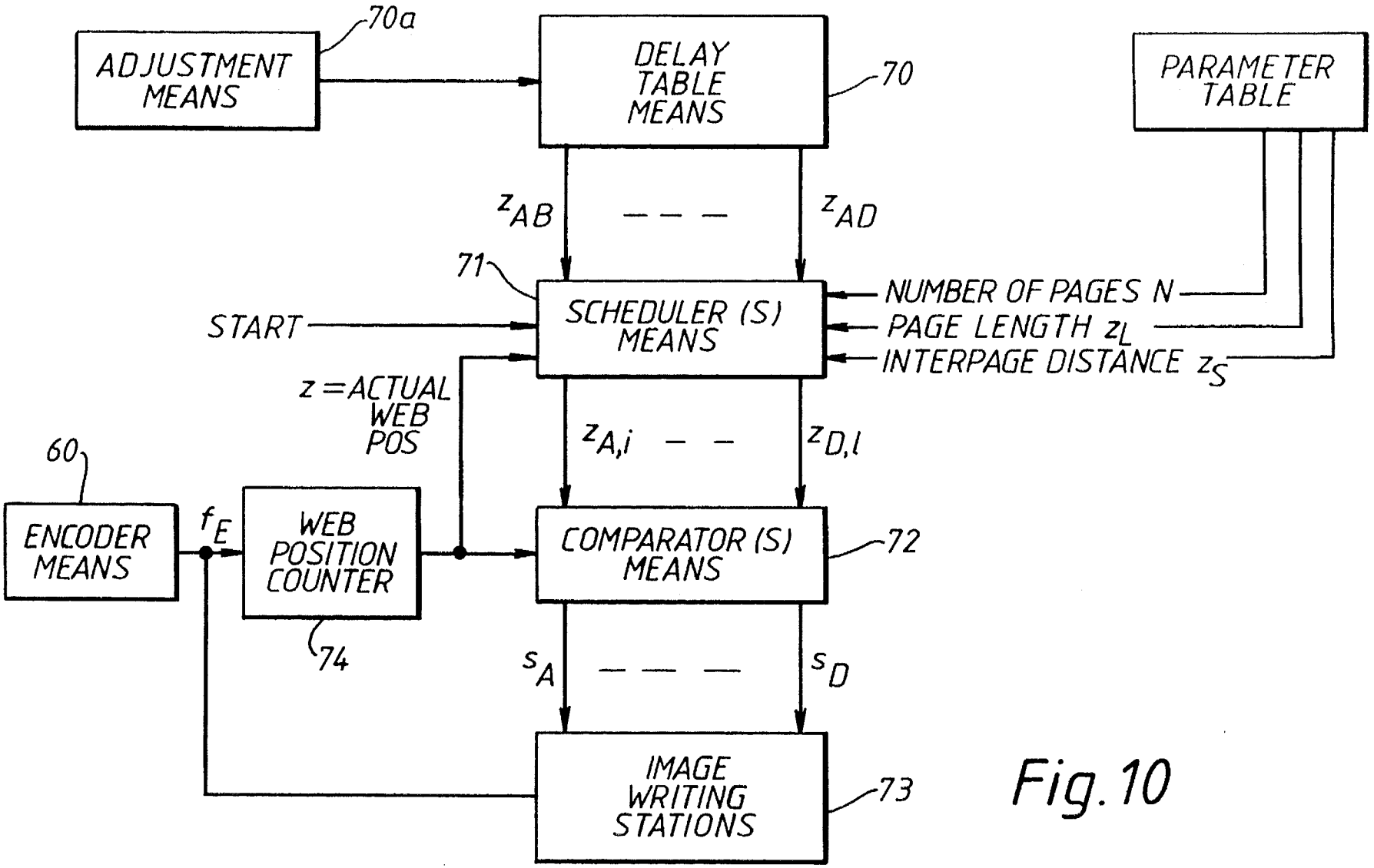

FIG. 10 shows a schematic arrangement of register control means for controlling the registration of images in a printer according to the invention.

Figure 11A:
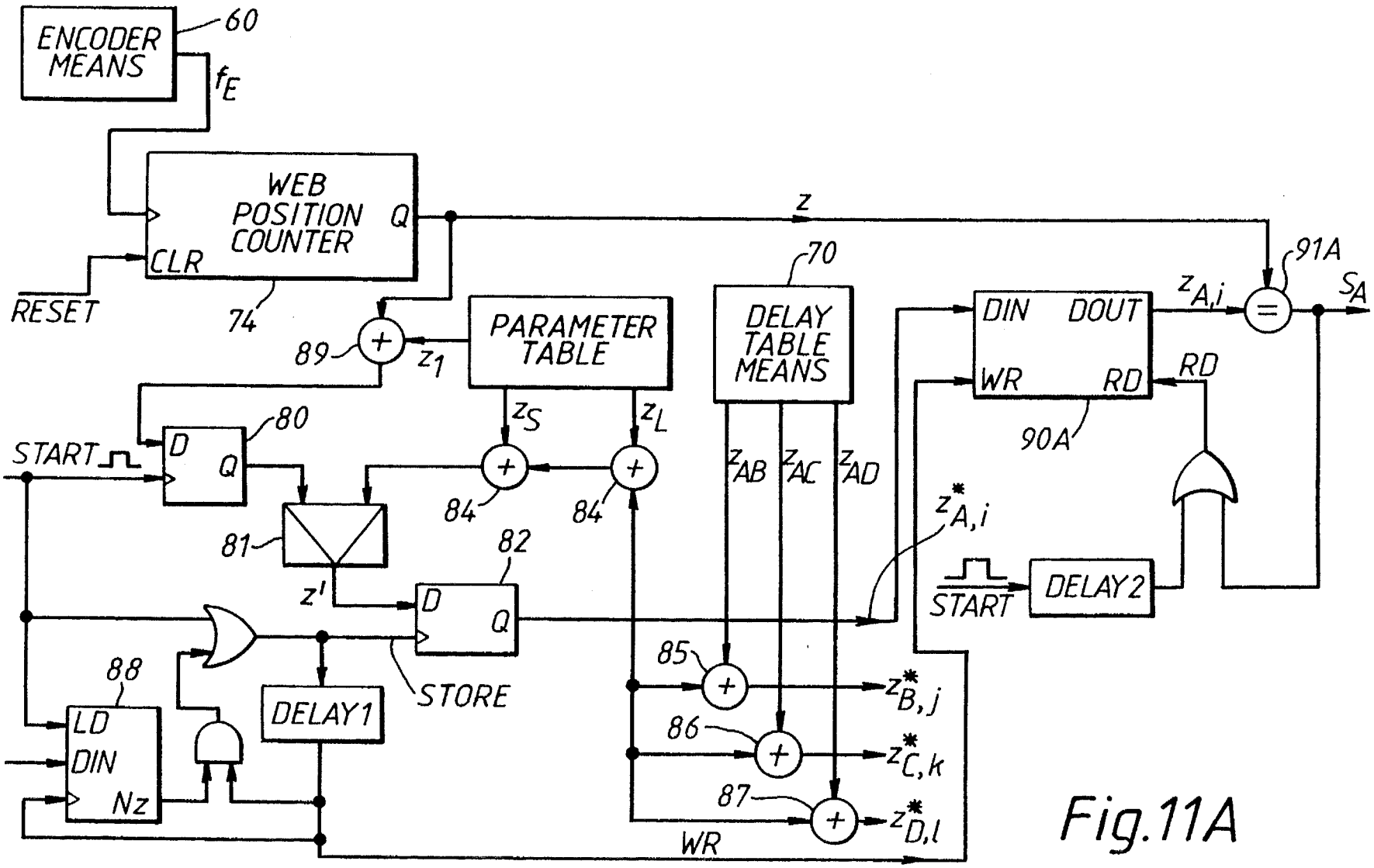
Figure 11B:
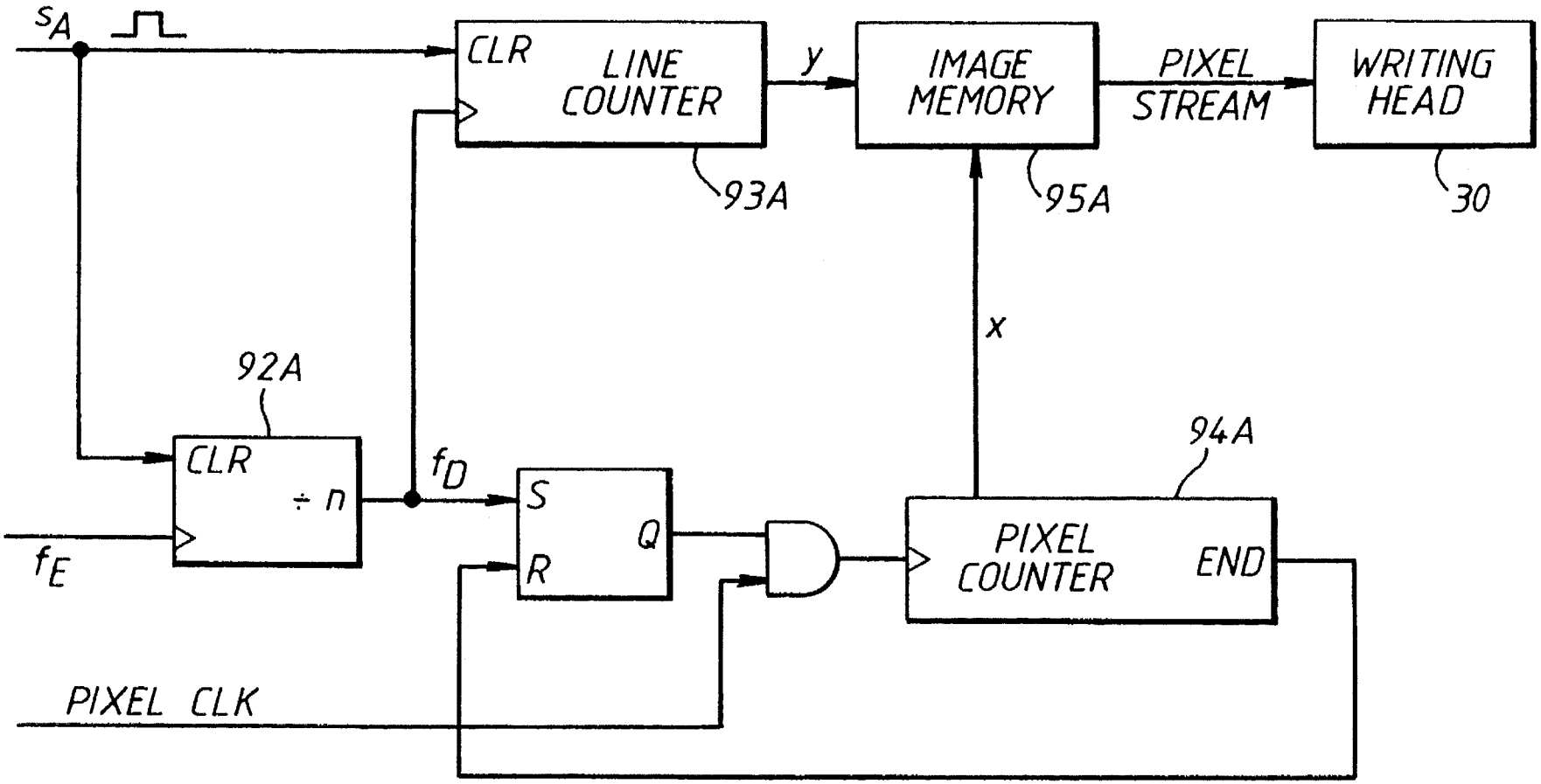

FIGS. 11A and 11B show in detail one embodiment of the control circuit for controlling the registration of images in a printer according to the invention, the figure being shown in two parts:

FIG. 11A shows the offset table, scheduler, encoder and web position counter; and FIG. 11B shows the comparator and image transfer station A.

Figure 12:
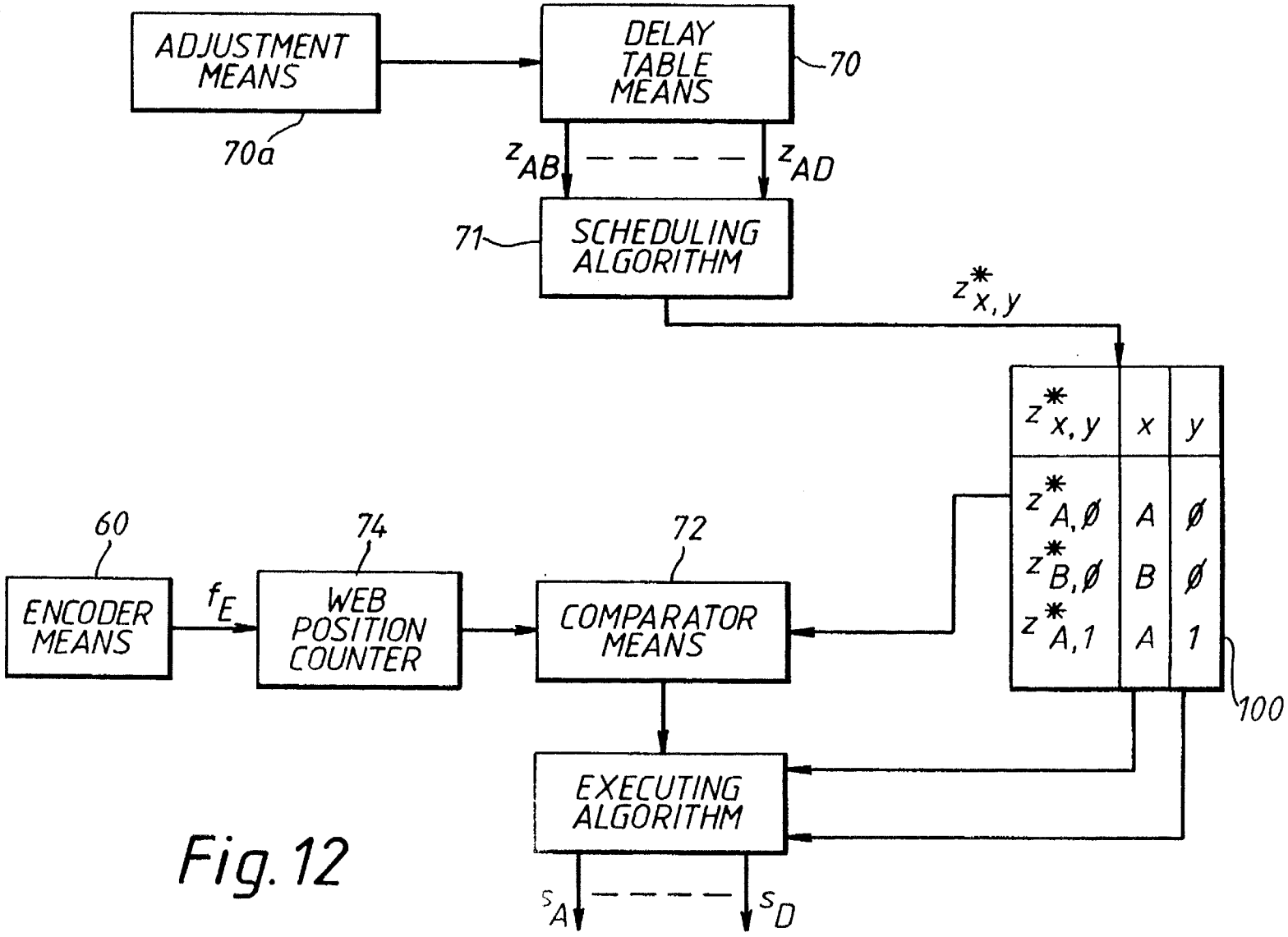

FIG. 12 shows an alternative embodiment of a control circuit for controlling the registration of images in a printer according to the invention.

Figure 13:
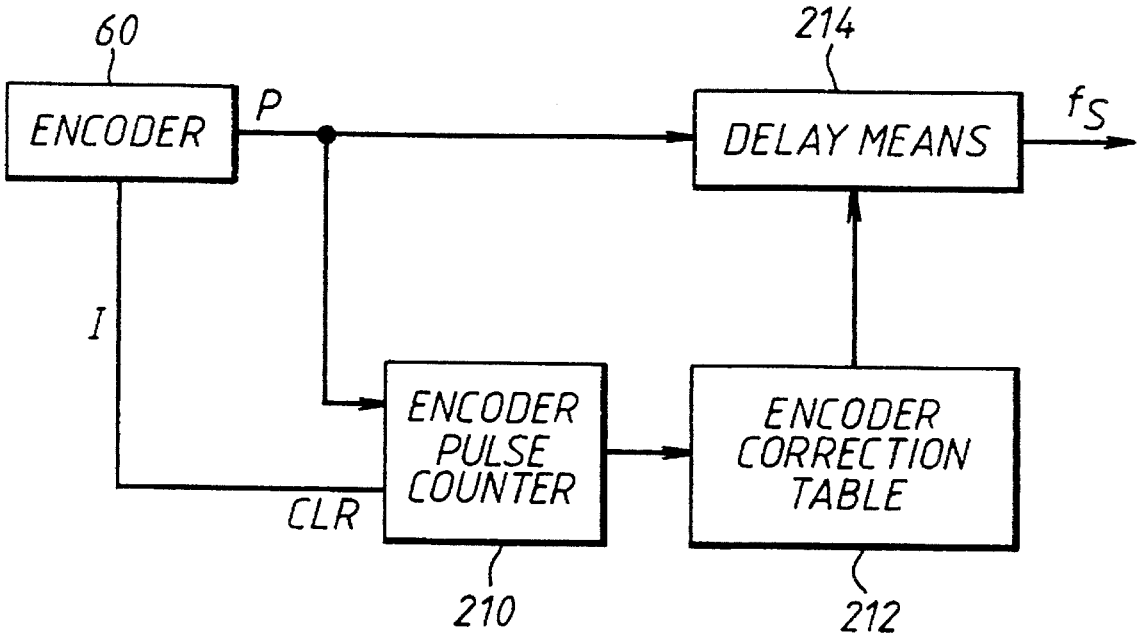

FIG. 13 shows a schematic arrangement of a preferred embodiment of the encoder correction means.

Figure 14:
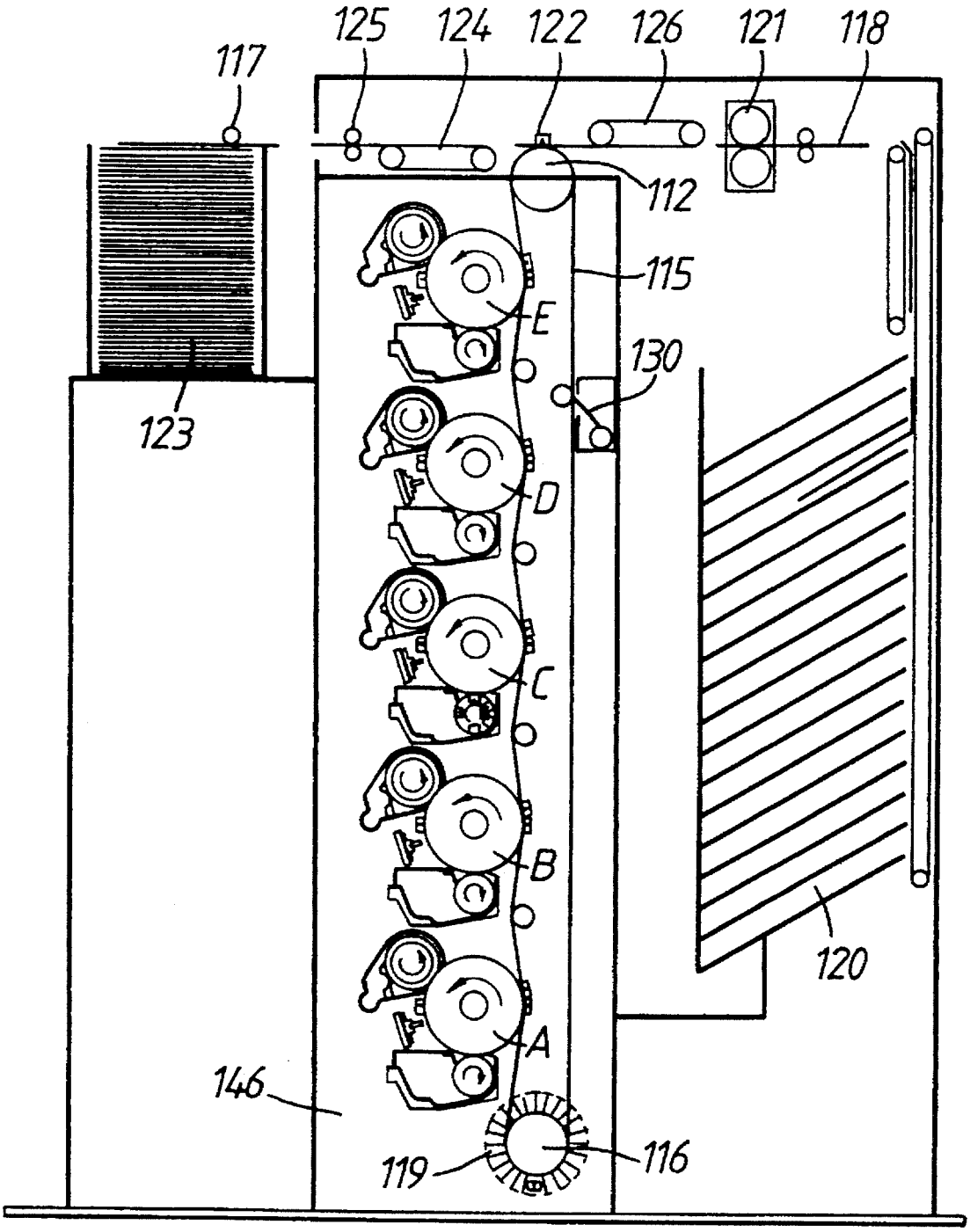

FIG. 14 shown an alternative printer according to the invention, suitable for simplex printing of sheet material.

Figure 15:
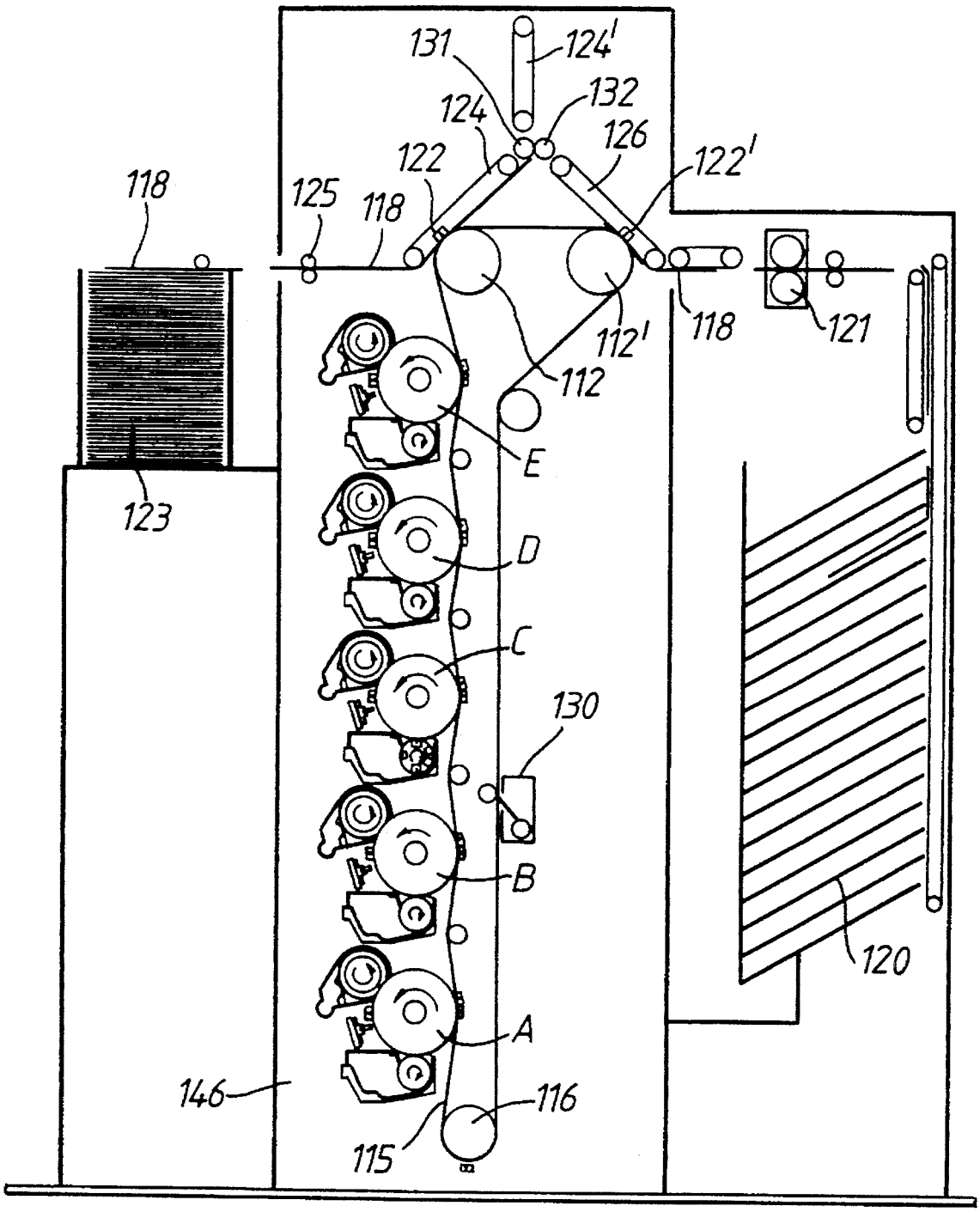

FIG. 15 shows an alternative printer according to the invention for the duplex printing of sheet material.

Figure 16:
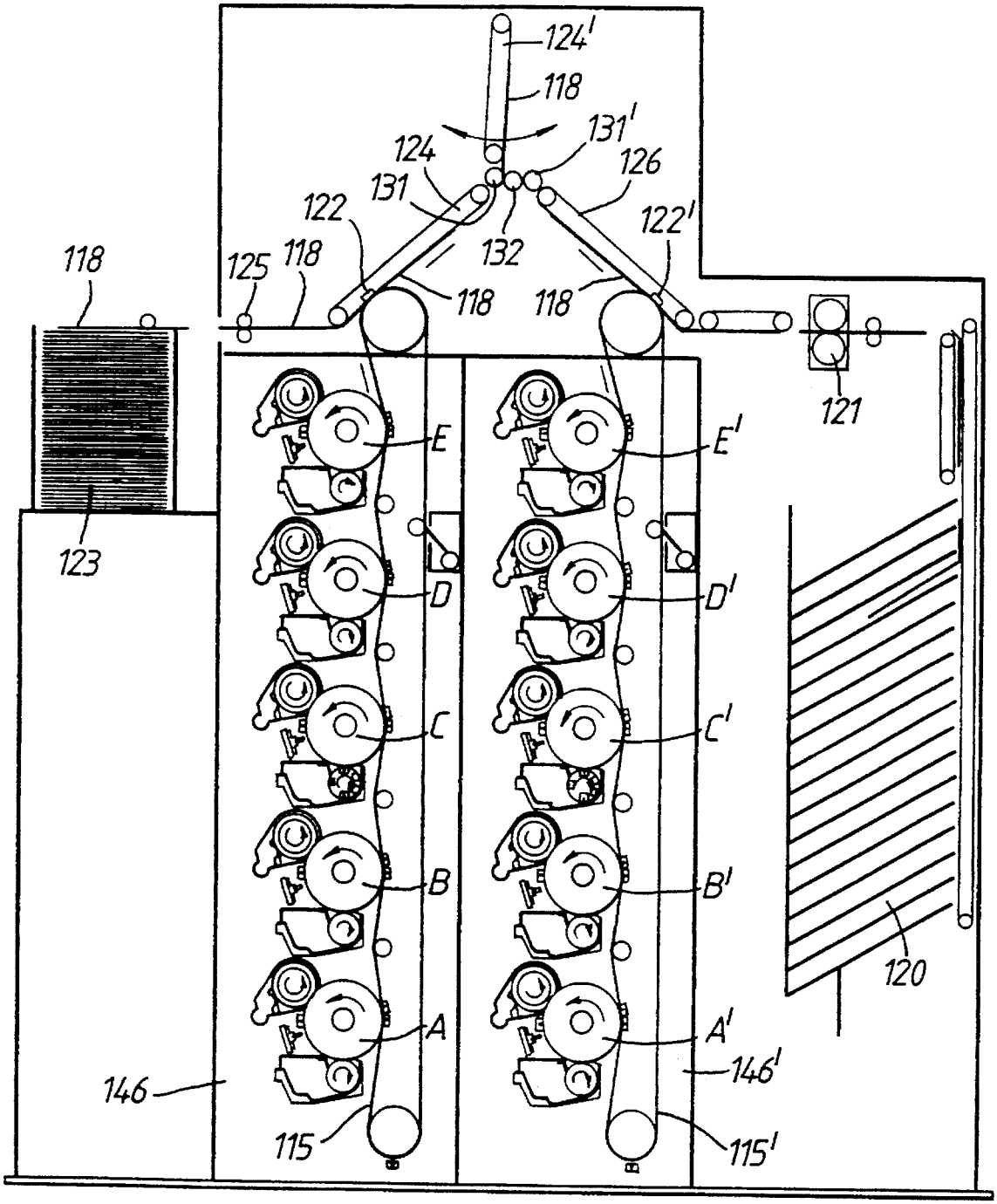
Figure 17E:
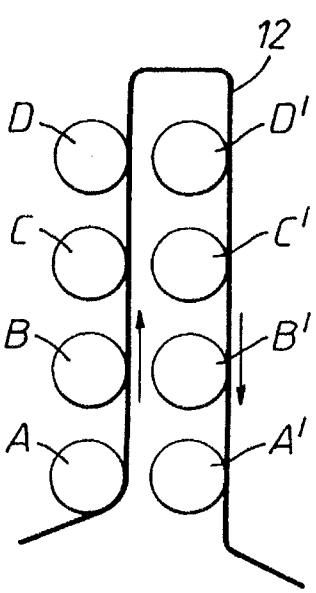
Figure 17D:
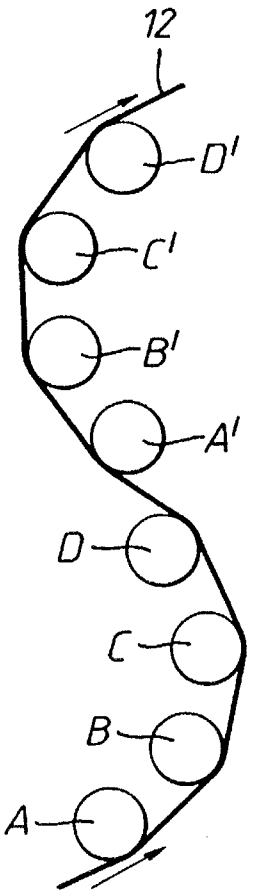
Figure 17C:
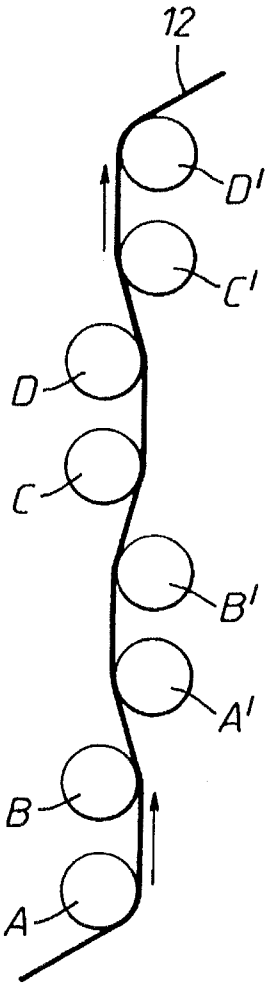
Figure 17B:
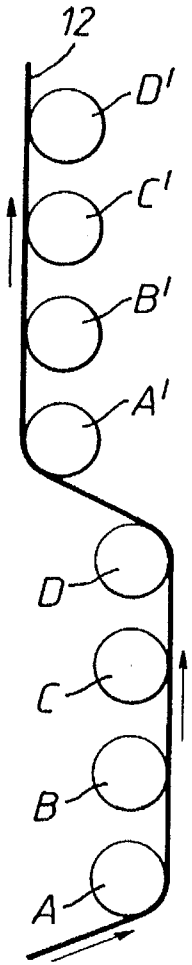
Figure 17A:
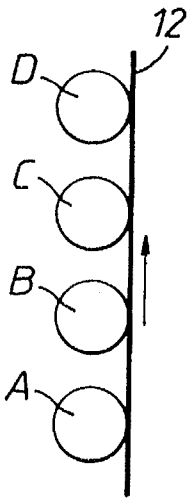

FIG. 16 shown another alternative printer according to the invention for the duplex printing of sheet material.

FIGS. 17A to 17E show a number of alternative arrangements of printing stations for use in printers according to the invention.

In the description which follows, the formation of images by the "reversal" development mode is described. One skilled in the art will appreciate however, that the same principles can be applied to "direct" development mode image forming.

The printer 10 in FIG. 1 comprises 4 printing stations A, B, C and D which are arranged to print yellow, magenta, cyan and black images respectively.

The printing stations ie, image-producing stations) A, B, C and D are arranged in a substantially vertical configuration, although it is of course possible to arrange the stations in a horizontal or other configuration. A web of paper 12 unwound from a supply roller 14 is conveyed in an upwards direction past the printing stations in turn. The moving web 12 is in face-to-face contact with the drum surface 26 over a wrapping angle ω of about 15°(see FIG. 2) determined by the position of guide rollers 36. After passing the last printing station D, the web of paper 12 passes through an image-fixing station 16, an optional cooling zone 18 and thence to a cutting station 20 to cut the web 12 into sheets. The web 12 is conveyed through the printer by a motor-driven drive roller 22 and tension in the web is generated by the application of a brake 11 acting upon the supply roller 14.

Figure 2:
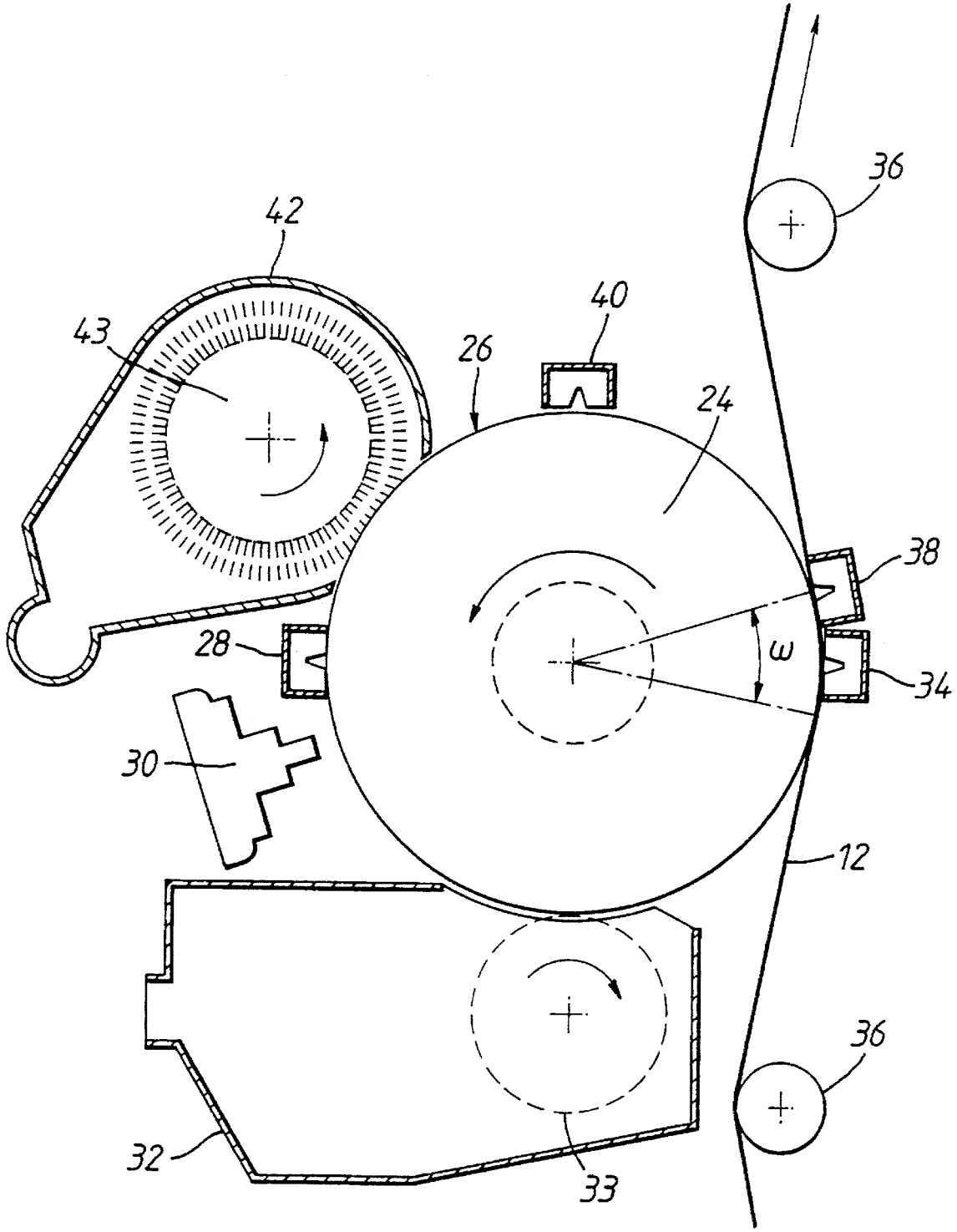
FIG. 2 shows in detail a cross-section of one of the print stations of the printer shown in FIG. 1.

As shown in FIG. 2, each printing station comprises a cylindrical drum 24 having a photoconductive outer surface 26. Circumferentially arranged around the drum 24 there is a main corotron or scorotron charging device 28 capable of uniformly charging the drum surface 26, for example to a potential of about −600V, an exposure station 30 which may, for example, be in the form of a scanning laser beam or an LED array, which will image-wise and line-wise expose the photoconductive drum surface 26 causing the charge on the latter to be selectively reduced, for example to a potential of about −250V, leaving an image-wise distribution of electric charge to remain on the drum surface 26. This so-called "latent image" is rendered visible by a developing station 32 which by means known in the art will bring a developer in contact with the drum surface 26. The developing station 32 includes a developer drum 33 which is adjustably mounted, enabling it to be moved radially towards or away from the drum 24 for reasons as will be explained further below. According to one embodiment, the developer contains (i) toner particles containing a mixture of a resin, a dye or pigment of the appropriate colour and normally a charge-controlling compound giving triboelectric charge to the toner, and (ii) carrier particles charging the toner particles by frictional contact therewith. The carrier particles may be made of a magnetizable material, such as iron or iron oxide. In a typical construction of a developer station, the developer drum 33 contains magnets carried within a rotating sleeve causing the mixture of toner and magnetizable material to rotate therewith, to contact the surface 26 of the drum 24 in a brush-like manner. Negatively charged toner particles, triboelectrically charged to a level of, for example 9 μC/g, are attracted to the photo-exposed areas on the drum surface 26 by the electric field between these areas and the negatively electrically biased developer so that the latent image becomes visible.

After development, the toner image adhering to the drum surface 26 is transferred to the moving web 12 by a transfer corona device 34. The moving web 12 is in face-to-face contact with the drum surface 26 over a wrapping angle ω of about 15°determined by the position of guide rollers 36. The charge sprayed by the transfer corona device, being on the opposite side of the web to the drum, and having a polarity opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about 3 mA/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not tend to wrap around the drum beyond the point dictated by the positioning of a guide roller 36 and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, for example −580V, by a pre-charging corotron or scorotron device 40. The pre-charging makes the final charging by the corona 28 easier. Thereby, any residual toner which might still cling to the drum surface may be more easily removed by a cleaning unit 42 known in the art. Final traces of the preceding electrostatic image are erased by the corona 28. The cleaning unit 42 includes an adjustably mounted cleaning brush 43, the position of which can be adjusted towards or away from the drum surface 26 to ensure optimum cleaning. The cleaning brush 43 is earthed or subject to such a potential with respect to the drum as to attract the residual toner particles away from the drum surface. After cleaning, the drum surface is ready for another recording cycle.

After passing the first printing station A, as described above, the web passes successively to printing stations B, C and D, where images in other colours are transferred to the web. It is critical that the images produced in successive stations be in registration with each other. In order to achieve this, the start of the imaging process at each station has to be critically timed. However, accurate registration of the images is possible only if there is no slip between the web 12 and the drum surface 26.

The electrostatic adherent force between the web and the drum generated by the transfer corona device 34, the wrapping angle ω determined by the relative position of the drum 24 and the guide rollers 36, and the tension in the web generated by the drive roller 22 and the braking effect of the brake 11 are such as to ensure that the peripheral speed of the drum 24 is determined substantially only by the movement of the web 12, thereby ensuring that the drum surface moves synchronously with the web.

The rotatable cleaning brush 43 which is driven to rotate in a sense the same as to that of the drum 24 and at a peripheral speed of, for example twice the peripheral speed of the drum surface. The developing unit 32 includes a brush-like developer drum 33 which rotates in a sense opposite to that of the drum 24. The resultant torque applied to the drum 24 by the rotating developing brush 33 and the counter-rotating cleaning brush 43 is adjusted to be close to zero, thereby ensuring that the only torque applied to the drum is derived from the adherent force between the drum 24 and the web 12. Adjustment of this resultant force is possible by virtue of the adjustable mounting of the cleaning brush 43 and/or the developing brush 33 and the brush characteristics.

Figure 3:
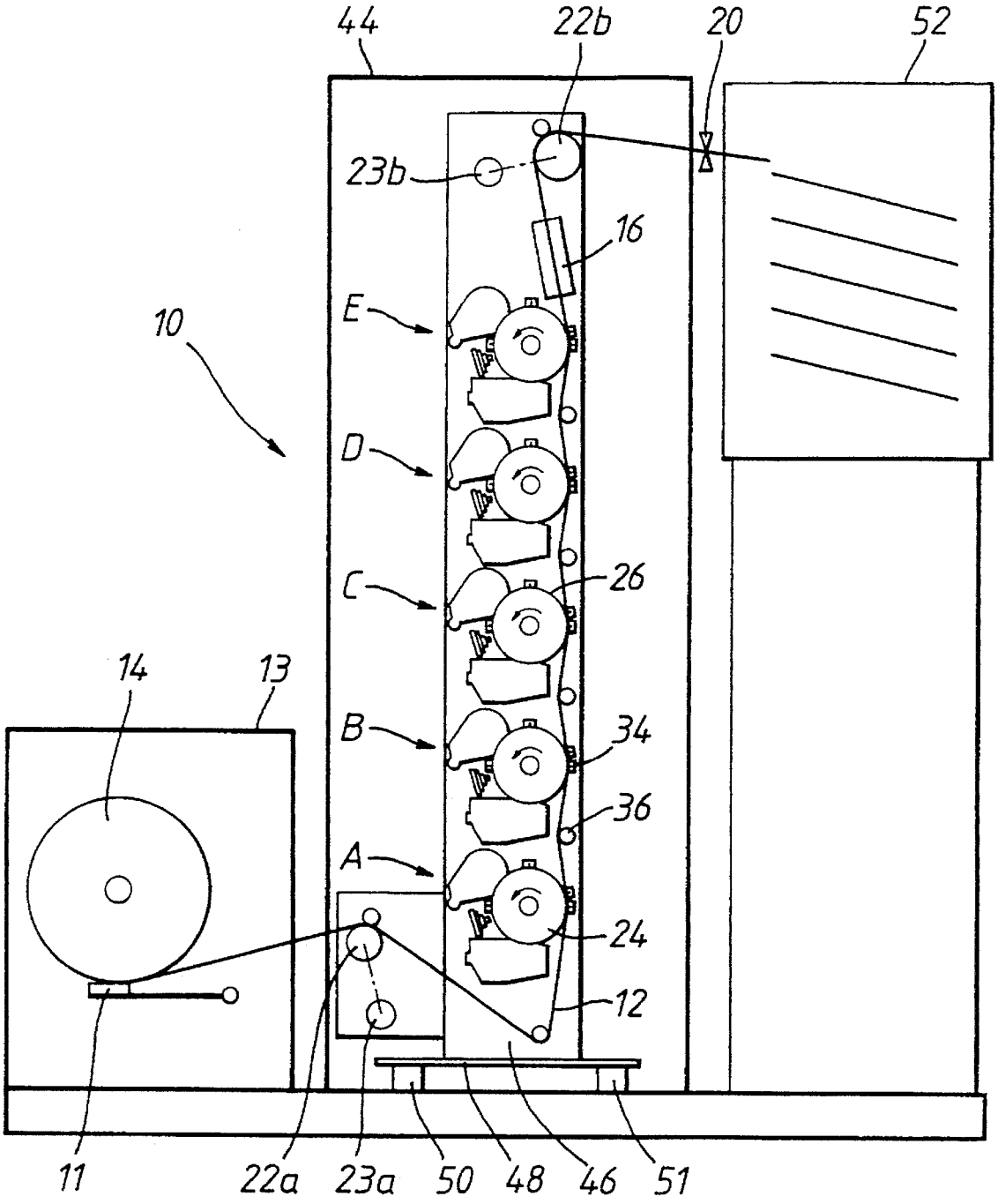
FIG. 3 shows the printer according to FIG. 1 in a less schematic representation, showing the positional relationship of the various parts thereof.

Referring to FIG. 3, there is shown a printer having a supply station 13 in which a roll 14 of web material 12 is housed, in sufficient quantity to print, say, up to 5,000 images. The web 12 is conveyed into a tower-like printer housing 44 in which a support column 46 is provided, housing four similar printing stations A to D. In addition, a further station E is provided in order to optionally print an additional colour, for example a specially customised colour, for example white. The printing stations A to E are mounted in a substantially vertical configuration resulting in a reduced footprint of the printer and additionally making servicing easier. The column 46 may be mounted against vibrations by means of a platform 48 resting on springs 50, 51.

After leaving the final printing station E, the image on the web is fixed by means of the image-fixing station 16 and fed to a cutting station 20 (schematically represented) and a stacker 52 if desired.

The web 12 is conveyed through the printer by two drive rollers 22*a*, 22*b* one positioned between the supply station 13 and the first printing station A and the second positioned between the image-fixing station 16 and the cutting station 20. The drive rollers 22*a*, 22*b* are driven by controllable motors, 23*a*, 23*b*. One of the motors 23*a*, 23*b* is speed controlled at such a rotational speed as to convey the web through the printer at the required speed, which may for example be about 125 mm/sec. The other motor is torque controlled in such a way as to generate a web tension of, for example, about 1 N/cm web width.

In FIG. 4 there is shown a duplex printer which differs from the printer shown in FIG. 3 in that there are two support columns 46 and 46', housing printing stations A to E, and A' to E' respectively.

After leaving the printing station E the web passes over upper direction-reversing rollers 54, 55 before entering the first image-fixing station 16. Towards the bottom of the printer the web 12, with a fixed image on one face, passes over lower direction-reversing rollers 56, 57 to enter the second column 46' from the bottom. The web 12 then passes the printing stations A' to E' where a second image is printed on the opposite side of the web, the path of which is reversed by the reversing roller 150, which is associated with means illustrated in FIGS. 5A and 5B for counteracting toner-deposition on the surface thereof. The second image is fixed by the image-fixing station 16'. In the particular embodiment shown in FIG. 4, all components of the printing stations are identical (except for the colour of the toner) and this gives both operating and servicing advantages.

FIG. 5 shows a more compact version of the duplex printer shown in FIG. 4. As in the case of FIG. 4, two columns 46 and 46' are provided each housing printing stations A to E and A' to E' respectively. For the sake of clarity, the columns 46 and 46' are not fully shown in FIG. 5. In contra-distinction to FIG. 4, the columns 46 and 46' are mounted closely together so that the web 12 travels in a generally vertical path defined by the facing surfaces of the imaging station drums 24, 24'. This arrangement is such that each imaging station drum acts as the guide roller for each adjacent drum by defining the wrapping angle. In the particular embodiment of FIG. 5, there is no need for an intermediate image-fixing station. The arrangement is more compact than the embodiment of FIG. 4. The paper web path through the printer is shorter and this gives advantages in reducing the amount of paper web which is wasted when starting up the printer. By avoiding the use of intermediate fixing, front-to-back registration of the printed images is made easier. Although in FIG. 5 the columns 46 and 46' are shown as being mounted on a common platform 48, it is possible in an alternative embodiment for the columns 46 and 46' to be separately mounted, such as for example being mounted on horizontally disposed rails so that the columns may be moved away from each other for servicing purposes and also so that the working distance between the columns may be adjusted.

Figure 5A:
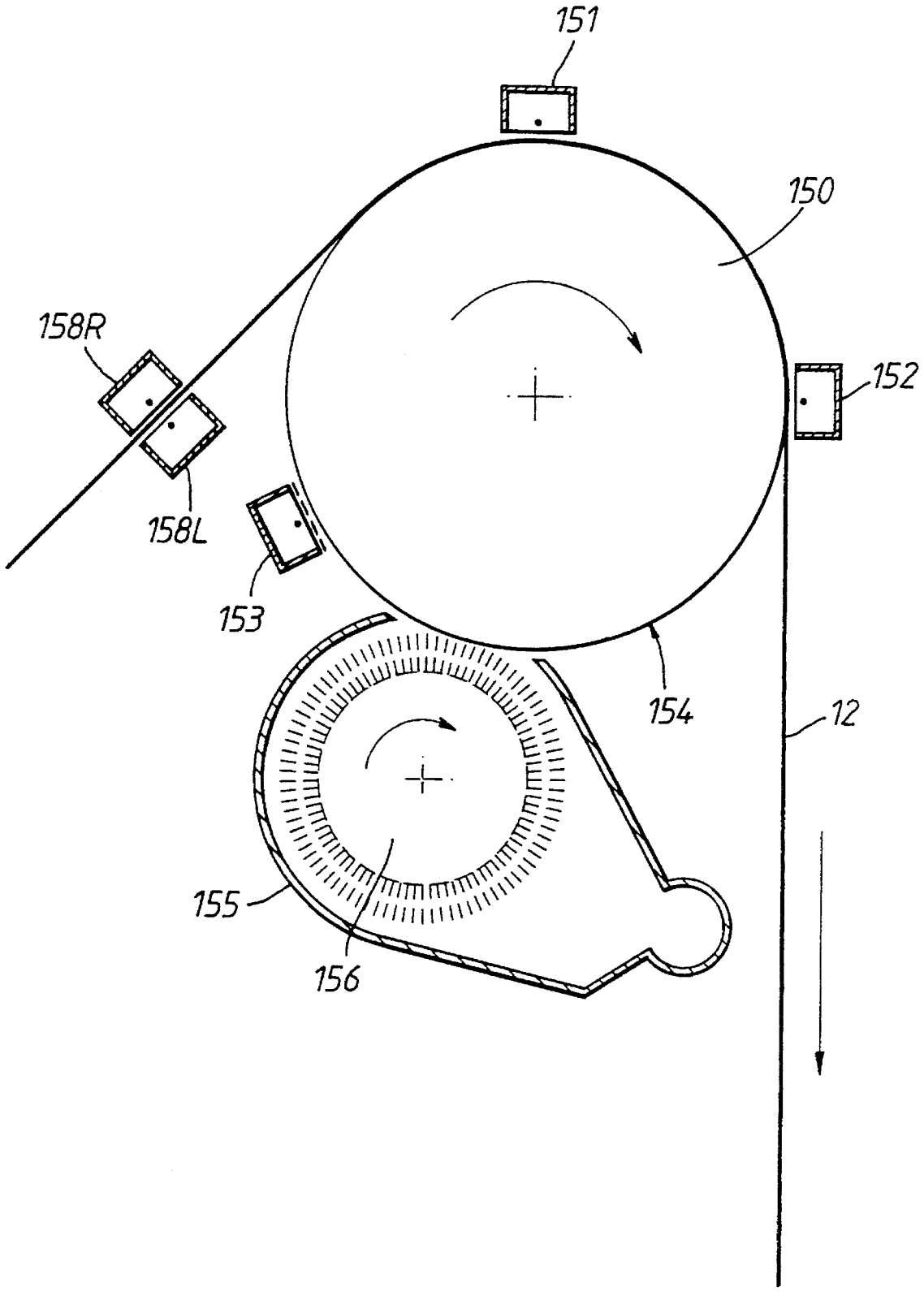
FIG. 5A shows a reversing roller for use with a printer as shown in FIG. 4 or FIG. 5, the reversing roller being arranged in conjunction with several means for counteracting toner image distortion on a web before final fixing of the toner particles on said web.

As shown in more detail in FIG. 5A, in the printer shown in FIG. 4 or FIG. 5, the receptor material web 12 moves along a web transport path over a freely rotatable reversing roller 150. The reversing roller 150 has an electrically conductive core and is coated with an electrically insulating material, preferably a smooth and abhesive material, such as a highly fluorinated polymer, preferably TEFLON (tradename), allowing electrostatic charging by corona. The roller surface 154 has no or poor adhesion with respect to the toner particles.

The wrapping angle of the web about the reversing roller 150 is about 135°. The web 12 carries an electrostatically charged toner image on both sides thereof. The linear movement of web 12 is maintained in synchronism with the peripheral speed of the surface of the reversing roller 150 by virtue of the fact that the latter is freely rotatable. A potential difference between the roller 150 and the web 12 is obtained by means of corona charging device 151 driven by direct current. The web 12 is therefore electrostatically attracted over the contacting zone of web and roller, so that the roller 150, being at a fixed potential, preferentially at earth potential, is driven by web 12 and no slippage takes place, so that no smearing of the toner image could take place.

A discharging corona device 152 operated with alternating current, enables easy release of the web 12 from the roller surface 154.

According to the embodiment illustrated in FIG. 5A, upstream of the reversing roller 150 the web 12 passes between a pair of corona charge devices 158R, 158L of opposite polarity. Hereby, the toner particles carried on the outer surface of the web 12, which surface does not contact the reversing roller 150, obtain a polarity the same as the polarity of the corona charge flux of the corona 151.

While the pair of corona devices 158L, 158R may be constituted by DC coronas of opposite polarity, however, since a negative DC corona tends to produce a non-uniform discharge along its length, it is advantageous to replace in said pair the negative DC corona by an AC corona device. This AC corona in combination with a positive DC corona at the opposite side of the paper web 12 produces a net negative charge that is more uniform.

The transfer of toner particles to the reversing roller 150 that is earthed or at a fixed potential, is counteracted by charging the roller surface 154 with corona 153, preferably a scorotron, before contacting the web 12 carrying the toner images. The charge polarity of said corona 153 is the same as the polarity of the toner particles that will come into contact with the roller surface 154.

Any residual toner that may cling to the roller surface 154 after release of the web 12 from the roller 150, will be removed by means of a cleaning device 155. The cleaning device 155 includes a cleaning brush 156 which rotates in the same rotational sense as the reversing roller 150. The cleaning brush 156 is earthed or subject to such a potential that adhering residual toner particles are attracted away from the roller surface 154.

Figure 5B:
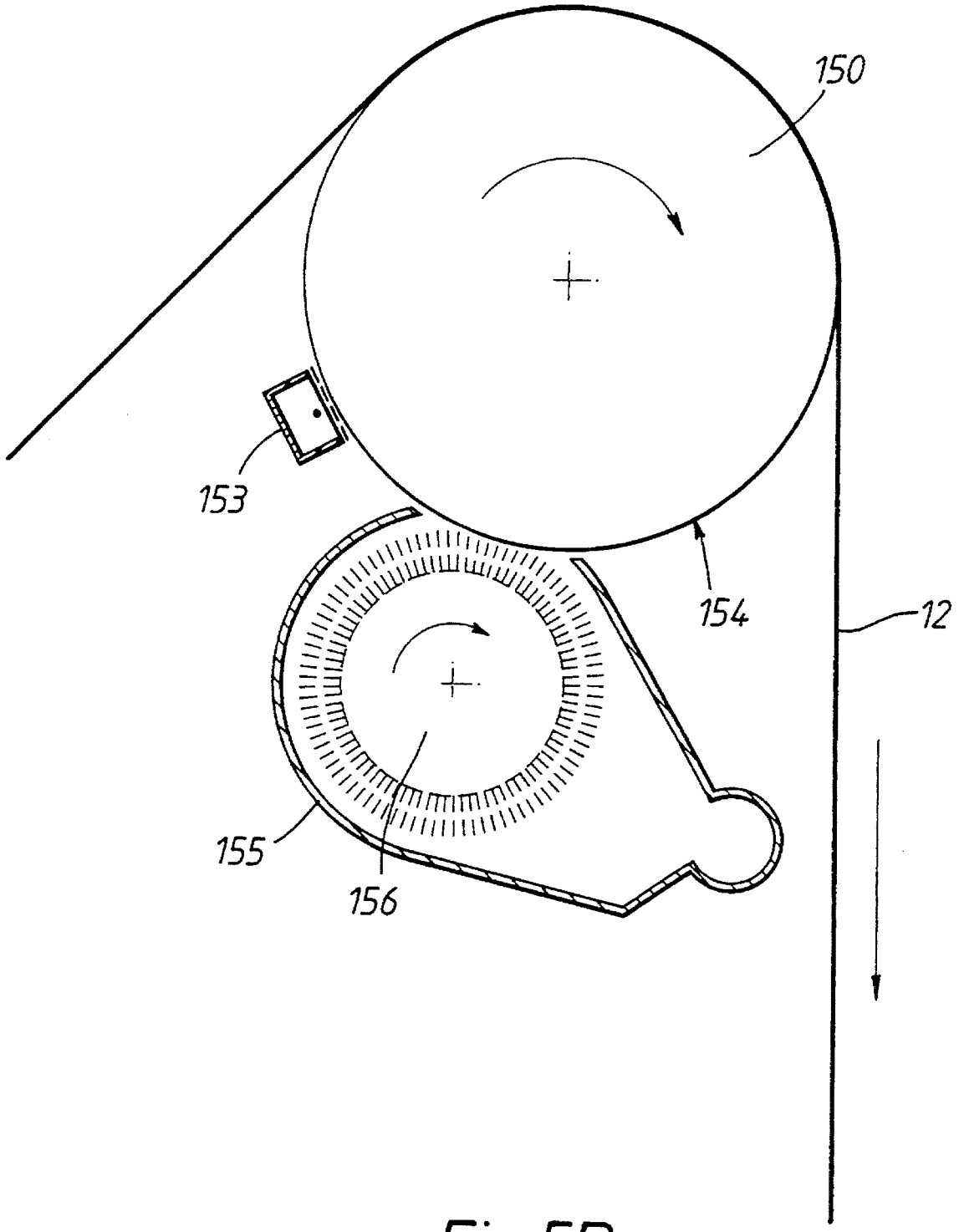
FIG. 5B shows a reversing roller arranged in conjunction with a simpler arrangement of means for counteracting toner image distortion on a web before final fixing of the toner particles on said web.

In the alternative embodiment as shown in FIG. 5B, by sufficiently mechanically tensioning the web 12 on the reversing roller 150, the coronas 151 and 152 providing electrostatic attraction and release between the web and roller may be dispensed with. Further, in case the toner particles that will come into contact with the surface of the reversing roller 150, have a charge level sufficiently high and of opposite polarity to the corona charge of corona device 153, the corona pair 158R, 158L can be left out without giving rise to a significant image smudging by the reversing roller surface 154.

Referring to FIG. 6, there is shown the paper web 12 and the drums **24*a*, 24*a'* and 24*b* of three staggered printing stations of the printer shown in FIG. 5, operating in reversal development mode. The transfer corona devices 34*a*, 34*a'* and 34*b*** associated with these printing stations are also shown.

Referring to FIG. 6-3, it can be seen that the negatively charged drum **24*a*, carries on its surface 26*a* negatively charged toner particles indicated by open circles. The transfer corona device 34*a* provides a stream of positively charged ions which by virtue of the adjacent negatively charged drum 24*a* are attracted in that direction and are thereby deposited on one face 12R of the paper web 12. The attraction between the positive charges on the face 12R and the negatively charged toner particles of a first colour causes the latter to be deposited upon the face 12L of the paper web 12**.

Referring to FIG. 6-2, it can be seen that as the paper web 12 carrying the negatively charged toner particles on the face 12L thereof reaches the image-producing station A', the transfer corona device **34*a'* provides a stream of positively charged ions to be deposited on the face 12L of the paper web 12, causing the charge on the toner particles to reverse to positive. At this point negatively charged toner particles are deposited from the drum 24*a'* onto the face 12R of the paper web 12**.

Referring to FIG. 6-1, it can be seen that as the paper web 12 carrying the positively charged toner particles on the face 12L thereof reaches the image-producing station B, the transfer corona device **34*b* provides a stream of positively charged ions to be deposited on the face 12R of the paper web, causing the charge on the toner particles on that face to reverse to positive. At this point, negatively charged toner particles of a second colour, indicated by filled circles, are deposited from the drum 24*b* onto the face 12L of the paper web 12. However, as the positively charged toner particles of the first colour on the face 12L reach the negatively charged drum 24*b*, they are attracted thereto, encouraged by the repulsive force generated by the transfer corona device 34*b*** and are removed from the paper surface. The removal of toner particles in this manner causes a loss of colour density in the final print and a displacement of toner particles may occur at image boundaries.

FIG. 7 shows a solution to this problem. In advance of the third image-producing station B and also between each subsequent pair of opposite image-producing stations (not shown) an opposed pair of corona discharge devices 58L and 58R are positioned one on each side of the paper web 12. The polarity of the corona discharge devices 58L and 58R are chosen to reverse the charge carried on the toner particles carried on the adjacent face 12R and 12L respectively of the paper web 12. As will be seen from FIG. 7-3, between stations A' and B, the positively charged toner particles on the face 12L of the paper web 12 are reversed to carry a negative charge as they pass the negative corona device 58L, while the negatively charged toner particles on the face 12R of the paper web 12 are reversed to carry a positive charge as they pass the negative corona device 58R. As can be seen from FIG. 7-1, the toner particles of the first colour on the face 12L are now negatively charged as they reach the negatively charged drum **24*b* and they are therefore repelled by the charge on the drum preventing their removal from the paper web, assisted by the positive charges from the transfer corona 34*b*. The paper web therefore continues to the next station in the printer carrying toner particles of both the first and second colours on the face 12L** in the desired amounts according to the image to be produced.

FIG. 8 is similar to FIG. 7, but additionally shows the web discharge corona devices **38*a*, 38*a'* and 38*b* (shown in FIGS. 8-4, 8-2, and 8-1** respectively) associated with each printing station to reduce the positive charges on the adjacent side of the web and prevent sparking in the post-transfer gap between the web and the drum.

In FIG. 7, the corona devices 58L and 58R have been described as DC coronas of opposite polarity. Since a negative DC corona tends to produce a non-uniform discharge along its length, it is advantageous to replace this negative DC corona by an AC corona device. This AC corona device (58L) in combination with the positive DC corona device (58R) produces a net negative charge that is more uniform.

Although FIGS. 6, 7 and 8 illustrate "reversal" development mode printing, it will be clear to those skilled in the art that the same general principles can be applied to "direct" development mode printing. Thus, referring to FIG. 6A, there is shown the paper web 12 and the drums **24*a*, 24*a'* and 24*b* of three staggered image-producing stations of the printer shown in FIG. 5, operating in direct development mode. The transfer corona devices 34*a*, 34*a'* and 34*b* associated with these stations are also shown in FIGS. 6A-3, 6A-2, and 6A-1** respectively.

Referring to FIG. 6A-3, it can be seen that the negatively charged drum **24*a*, carries on its surface 26*a* positively charged toner particles indicated by open circles. The transfer corona device 34*a* provides a stream of negatively charged ions which by virtue of the adjacent negatively charged drum 24***a* are attracted in that direction and are thereby deposited on one face 12R of the paper web 12. The attraction between the negative charges on the face 12R and the positively charged toner particles of a first colour causes the latter to be deposited upon the face 12L of the paper web 12.

Referring to FIG. 6A-2, it can be seen that as the paper web 12 carrying the positively charged toner particles on the face 12L thereof reaches the image-producing station A', the transfer corona device 34*a'* provides a stream of negatively charged ions to be deposited on the face 12L of the paper web 12, causing the charge on the toner particles to reverse to negative. At this point positively charged toner particles are deposited from the drum 24*a'* onto the face 12R of the paper web 12.

Referring to FIG. 6A-1, it can be seen that as the paper web 12 carrying the negatively charged toner particles on the face 12L thereof reaches the image-producing station B, the transfer corona device 34*b* provides a stream of negatively charged ions to be deposited on the face 12R of the paper web, causing the charge on the toner particles on that face to reverse to negative. At this point, positively charged toner particles of a second colour, indicated by filled circles, are deposited from the drum 24*b* onto the face 12L of the paper web 12. However, as the negatively charged toner particles of the first colour on the face 12L reach the photo-discharged areas of the surface of the drum 24*b*, they are forced thereto, encouraged by the repulsive force generated by the transfer corona device 34*b* and are removed from the paper surface. The removal of toner particles in this manner causes a loss of colour density in the final print and a displacement of toner particles may occur at image boundaries.

FIG. 7A shows a solution to this problem. In advance of the third image-producing station B and also between each subsequent opposite image-producing station (not shown) a pair of corona discharge devices 58L and 58R of opposite polarity are positioned one on each side of the paper web 12. The polarity of the corona discharge devices 58L and 58R are chosen to reverse the charge carried on the toner particles carried on the adjacent face 12R and 12L respectively of the paper web 12. As will be seen from FIG. 7A-3, between stations A' and B, the negatively charged toner particles on the face 12L of the paper web 12 are reversed to carry a positive charge as they pass the positive corona device 58L, while the positively charged toner particles on the face 12R of the paper web 12 are reversed to carry a negative charge as they pass the negative corona device 58R. As can be seen from FIG. 7A-1, the toner particles of the first colour on the face 12L are now positively charged as they reach the image-producing station B and are encouraged by the attractive force generated by the negative transfer corona device 34*b* to be retained on the paper surface. The paper web therefore continues to the next station in the printer carrying toner particles of both the first and second colours on the face 12L in the desired amounts according to the image to be produced.

FIG. 8A is similar to FIG. 7A, but additionally shows the web discharge corona devices 38*a*, 38*a'* and 38*b* associated with each printing station in FIGS. 8A-4, 8A-2, and 8A-1 respectively.

It is possible to avoid the problems demonstrated in FIGS. 6 and 6A by utilizing opposite drum and toner polarities at adjacent printing stations, as shown in FIG. 6B.

Referring to FIG. 6B, there is shown the paper web 12 and the drums 24*a*, 24*a'* and 24*b* of three staggered printing stations of the printer shown in FIG. 5, operating in reversal development mode. The transfer corona devices 34*a*, 34*a'* and 34*b* associated with these printing stations are also shown in FIGS. 6B-3, 6B-2, and 6B-1 respectively.

Referring to FIG. 6B-3, it can be seen that the positively charged drum 24*a*, carries on its surface 26*a* positively charged toner particles indicated by open circles. The transfer corona device 34*a* provides a stream of negatively charged ions which by virtue of the adjacent positively charged drum 24*a* are attracted in that direction and are thereby deposited on one face 12R of the paper web 12. The attraction between the negative charges on the face 12R and the positively charged toner particles of a first colour causes the latter to be deposited upon the face 12L of the paper web 12.

Referring FIG. 6B-2, it can be seen that as the paper web 12 carrying the positively charged toner particles on the face 12L thereof reaches the image-producing station A', the transfer corona device 34*a'* provides a stream of positively charged ions to be deposited on the face 12L of the paper web 12, causing the charge on the toner particles to be maintained as positive. At this point negatively charged toner particles are deposited from the drum 24*a'* onto the face 12R of the paper web 12.

Referring to FIG. 6B-1, it can be seen that as the paper web 12 carrying the positively charged toner particles on the face 12L thereof reaches the image-producing station B, the transfer corona device 34*b* provides a stream of negatively charged ions to be deposited on the face 12R of the paper web, causing the charge on the toner particles on that face to be maintained as negative. At this point, positively charged toner particles of a second colour, indicated by filled circles, are deposited from the drum 24*b* onto the face 12L of the paper web 12. As the positively charged toner particles of the first colour on the face 12L reach the positively charged drum 24*b*, they are repelled thereby, encouraged by the attractive force generated by the transfer corona device 34*b* and are retained on the paper surface.

The arrangement shown in FIG. 6B is however less preferred since that solution takes away the advantage that components at all printing stations are identical. Also the range of available positive colour toners is more limited than the range of available negative colour toners, which are therefore used throughout the printer for preference.

With reference to FIG. 9, and for the purpose of describing the operation of the register control means, we define:

writing points $A_1$, $B_1$, $C_1$ and $D_1$ being the position of the writing stations of the image printing stations A, B, C and D as projected, perpendicular to the drum surface, on the drum surface;

transfer points $A_2$, $B_2$, $C_1$ and $D_2$ being the points on the surface of drums 24*a*, 24*b*, 24*c* and 24*d* that coincide with the centre of the wrapping angle ω( see FIG. 2 );

lengths $l_{A2B2}$, $l_{B2C2}$ and $l_{C2D2}$ being the lengths measured along the web between the points $A_2$ and $B_2$, $B_2$ and $C_2$ and $C_2$ and $D_2$;

lengths $l_{A1A2}$, $l_{B1B2}$, $l_{C1C2}$ and $l_{D1D2}$ being the lengths measured along the surface of the drums 24*a*, 24*b*, 24*c* and 24*d* between the points $A_1$ and $A_2$, $B_1$ and $B_2$, $C_1$ and $C_2$ and $D_1$ and $D_2$.

In order to obtain good registration, the delay between writing an image at $A_1$ and writing a related image at $B_1$, $C_1$ or $D_1$ should be equal to the time required for the web to move over a length $l_{AB}$, $l_{AC}$ or $l_{AD}$, wherein:

$$l_{AB}=l_{A1A2}+l_{A2B2}-l_{B1B2} \text{ and consequently}$$

$$l_{AC}=l_{A1A2}+l_{A2B2}+l_{B2C2}-1C1C2 \text{ and}$$

$$l_{AD}=l_{A1A2}+l_{A2B2}+l_{B2C2}+l_{C2D2}-l_{D1D2}$$

In practice the lengths $l_{A1A2}$ etc., and $l_{A2B2}$ etc. will usually be designed to be nominally identical but, due to manufacturing tolerances, minor differences may not be avoided and for the purposes of explaining the principles of registration they are assumed not to be identical.

From the above equations, one derives easily a possible cause of mis-registration, ie that when using a fixed time $$t_{AB}=l_{AB}/V_{average}$$

with which the imaging at point $B_1$ is delayed from the imaging at point $A_1$, while the web speed v shows variations over this period of time, the web will have travelled over a length $$l_{AB}'=\int_0^{t_{AB}} v dt.$$

Since it is most likely that $l'_{AB}$ does not equal $l_{AB}$, the image written at point $B_l$ will, when being transferred onto the web, not coincide with the image written at point $A_1$, thus causing mis-registration.

Let $f_E$ be the pulse frequency being generated by the encoder means 60 wherein $f_z$ equals $n.f_D$, where n is a whole number; the line frequency $f_D$ being the frequency at which lines are printed ($f_D$=v/d) where d is the line distance.

Each encoder pulse is indicative of unit web displacement (ρ=d/n). The relative position of the web at any time is therefore indicated by the number of pulses z generated by the encoder.

Given that the relative distance 1 equals the distance over which the web has moved during a given period of time, then:

$$z=l/\rho$$

and, in accordance with the definitions of $l_{AB}$, $l_{AC}$ and $l_{AD}$ above, we can define:

$$z_{AB}=z_{A1A2}+z_{A2B2}-z_{B1B2}$$

$$z_{AC}=\ldots \text{ etc.}$$

Thus, by delaying the writing of an image at point $B_1$ by a number of encoder pulses $z_{AB}$ from the writing of an image at $A_1$, it is assured that both images will coincide when being transferred onto the web. This is so irrespective of any variation in linear speed of the paper web, provided that the drums 24*a* to 24*d* rotate in synchronism with the displacement of the paper web, as described above.

While the encoder 60 is shown in FIG. 9 as being mounted on a separate roller in advance of the printing stations A to D, we prefer to mount the encoder on one of the drums 24*a* to 24*d*, preferably on a central one of these drums. Thus, the web path between the drum carrying the encoder and the drum most remote therefrom is minimized thereby reducing any inaccuracies which may arise from unexpected stretching of the paper web 12, and of variations of $\mathbf{1}_{A2B2}$ etc. due to eccentricity of the drums or the guiding rollers, defining the wrapping angle ω.

A typical optical encoding device would comprise 650 equally-spaced marks on the periphery of a drum having a diameter of 140 mm in the field of vision of a static optical detection device. With a line distance of about 40 μm, this would generate 1 pulse per 16 lines.

Referring to FIG. 9A, there is shown an encoder 60 comprising an encoder disc 206 together with a frequency multiplier circuit. The frequency multiplier circuit, having very good phase tracking performance, multiplies the input encoder sensor frequency $f_s$ by a constant and integer number m. To obtain good register resolution, m is chosen high enough that $$f_E=mf_s=nf_D$$

thus $$f_s=nf_D/m.$$

It is necessary that $f_s$ is much less than $f_2$ and it therefore follows that m must be much higher than n.

A voltage controlled oscillator 203 generates a square waveform with a frequency $f_E$. This frequency is divided by m in the divider 204 to a frequency $f_m$, from which $\Theta_m$ is compared in phase comparator 205 with the phase $\Theta_s$ of the incoming frequency $f_s$ coming from the encoder sensor 201.

A low pass filter 202 filters the phase difference $\Theta_s-\Theta_m$ to a DC voltage $V_e$ which is fed to the voltage controlled oscillator 203.

With good phase tracking performance, the phase difference between $\Theta_s$ and $\Theta_m$ approaches zero, so that due to the frequency multiplication, there are m times more phase edges on $f_E$ between two encoder sensor input phase edges. Every phase edge of $f_E$ represents a web displacement of d/n.

The low pass filter 202 cancels out the high frequency variations in the encoder signal, which are normally not related to web speed variations but to disturbances caused by vibrations.

The time constant of the low pass filter 202 defines the frequency response of the multiplier so as to realize a cut-off frequency of, for example 10 Hz.

Referring to FIG. 10, encoder means 60 generates a signal with frequency $f_E$ being n times higher than the frequency ($f_D$) resulting from encoding the time it takes for the web 12 to advance over a distance equal to the line distance d. For a 600 dpi printer (line distance d=42.3 μm), a web speed of 122.5 mm/s results in a frequency $f_D$=2896 Hz.

A web position counter 74 counts pulses derived from the encoder 60 so that at any time, the output of the counter is indicative of a relative web position z, wherein each increment of z denotes a basic web displacement/propagation of ρ being 1/nth of the line distance d.

Delay table means 70 stores the predetermined values $Z_{AB}$, $Z_{AC}$, $Z_{AD}$ equalling the number of basic web displacements to be counted from the start of writing a first image on drum 24*a*, at point A1, to the moment the writing of subsequent images on drums 24*b*, 24*c* and 24*d*; at points B1, C1 and D1, so that the position of all subsequent images on the paper web 12 will correspond exactly to the position of the first image. The adjustment means 70*a* will be discussed further below with reference to FIG. 12.

Scheduler means 71 calculates the values $Z_{A,i}$, $Z_{B,j}$, $Z_{c,k}$ and $Z_{D,l}$; wherein each of these values represent the relative web position at which the writing of the ith, jth, kth and lth image should be started at image writing stations A, B, C and D. Given that values:

N=the number of images to print;

$z_L$=the length of an image expressed as a multiple of basic web displacements; and $z_S$=the space to be provided between two images on paper (also expressed as a multiple of basic web displacements).

The scheduler means can calculate the different values of $z_{A,i}\ldots z_{D,l}$ as follows.

When the START signal (the signal which starts the printing cycle) is asserted, then (assuming the first image is to be started at position $z_0+z_l$, wherein $z_0$ represents the web position at the moment the START signal is asserted) the position as shown in Table 1 occurs:

TABLE 1

| | | | |
|---|---|---|---|
| $z_{A,0} = z_0 + z_1$ | $z_{B,0} = z_0 + z_{AB} + z_1$ | ... | $z_{D,0} = z_0 + z_{AD} + z_1$ |
| $z_{A,1} = z_0 + z_L + z_S + z_1$ | $z_{B,1} = z_{A,1} + z_{AB} + z_1$ | ... | $z_{D,1} = z_{A,1} + z_{AD} + z_1$ |
| | $= z_0 + z_L + z_S + z_{AB} + z_1$ | ... | $= z_0 + z_L + z_S + z_{AD} + z_1$ |
| | . | | . |
| | . | | . |
| | . | | . |
| $z_{A,i} = z_0 + i(z_L + z_S) + z_1$ | $z_{B,j} = z_0 + z_{AB} + j(z_L + z_S) + z_1$ | ... | $z_{D,1} = z_0 + z_{AD} + l(z_{L+z_s}) + z_1$ |

Comparator means 72 continuously compares the values $Z_{A,i} \ldots Z_{D,l}$, wherein i, j, k and l start at 0 and stop at N-1, with the value z and, when match (es) are encountered generates signal(s) $s_A$ to $s_D$ after which the respective value (s) i to l are incremented.

Image writing stations 73, upon receipt of the trigger signal(s) $s_A$ to $s_D$, start the writing of the image at image writing station(s) A to D. Once the writing of an image has started, the rest of the image is written with a line frequency $f_D$ derived from $$f_D=f_E/n,$$

the frequency $f_D$ thus being in synchronism with the encoder output, the phase of which is zeroed at the receipt of the trigger signal.

The above described mechanism is of course not restricted to control only the registration of the different images on the paper, but can also be used for generating accurate web-position aware signals for any module in the printer. Examples of such modules are the cutter station 20, the stacker 52 (see FIG. 5).

Referring to FIGS. 11A and 11B, when the START pulse initiating the printing cycle is asserted, register 80 stores the sum $z_0=z_1$, as calculated by means of adder 89. Multiplexer 81 feeds this value through to register 82. Adders 85, 86 and 87 then calculate $z^*_{B,j}$, $z^*_{C,k}$ and $z^*_{D,l}$, with j, k and l being zero, being the scheduled web positions at which writing of the first image on the respective image transfer station should start, $z^*_{A,i}$, with i being zero, of course being equal to $z_0+z_1$. After a period of time equal to delay 1, these values are stored in the FIFO (first-in, first-out) memories 90A, 90B, 90C and 90D, of which for simplicity only FIFO 90A is shown. Meanwhile, adders 83 and 84 have calculated $z^*_{A,1}$ being $z^*_{A,0}+z_L+z_S$, and this value is fed through multiplexer 81 to register 82. Again, adders 85, 86 and 87 will then calculate from $z^*_{A,1}$ the values $z^*_{B,1}$, $z^*_{C,1}$ and $z^*_{D,1}$ which are again stored in the FIFO's 90A etc. This process continues until down-counter 88, which started at the value N and decrements with every write pulse storing a next series of values $z^*_{A,i}$ to $z^*_{D,l}$ into the FIFO's, reaches zero. When this has happened, all positions at which writing of an image should start are calculated and stored, in chronological order, in the FIFO memories.

Meanwhile, comparators 91A etc. are continuously comparing the web position z to the values $z_{A,i}$ to $Z_{D,l}$, where i to l are initially zero, as read from the FIFO's. When z equals $z_{A,0}$, the signal $s_A$ is asserted, which resets divider 92A (see FIG. 11B), thus synchronising the phase of the $f_D$ signal with the $s_A$ pulse for reasons of increased sub-line registration accuracy as explained above. Also line counter 93A is cleared which addresses line y=0 in the image memory 95A.

For every pulse of the $f_D$ signal, pixel counter 94A produces an up-counting series of pixel addresses x. As the image memory is organised as a two-dimensional array of pixels, the counting pixel address x, at the rate specified by the signal PIXEL-CLK (pixel clock), produces a stream of pixel values which are fed to the writing head 30 resulting in a line-wise exposure of the photoconductive drum surface 26. For every n pulses of the $f_E$ signal, a next line of pixels is fed to the writing heads. In this way the registration of the different images is not only accurate at the beginning of the image, but it also stays accurate within the image.

As soon as the writing of an image has started, the $s_A$ to $s_D$ signals will cause the next $z_{A,i}$ to $z_{D,l}$ value to be read from the FIFO memory 90A etc. so that the next copy of the image will be started as scheduled.

In the more preferred embodiment of the invention shown in FIG. 12, substantial parts of the control circuit are implemented by means of a software program being executed on a microprocessor chip. In this case, all functions offered by the electronic circuit of FIG. 11A, except for the encoder means, are replaced by a software code, thereby increasing the flexibility of the control circuit.

The calculated values $z^*_{A,i}$ to $z^*_{D,l}$ are preferably stored in one or more sorted tables 100 in the microprocessor's memory. As in the hardware solution, a comparator means 72 continuously compares the first entry in this list with the web position z as given by a web position counter 74, which is preferably software but possibly hardware assisted. Upon detection of a match between the two values, the microprocessor asserts the respective signal $s_A$ to $s_D$.

In order to calibrate the register means, the operator makes a test print, the print is examined and any misregistration error $\Delta$ is measured. A pulse number correction, equal to $\Delta/\rho$ is then added or subtracted from the values $z_{AB}$ etc. stored in the delay table 70 by the adjustment means 70*a*, using methods well known in the art.

Referring to FIG. 13, in order to correct the period of each individual pulse output from the encoder sensor means, the encoder means 60 produces an additional signal I which acts as an index for the encoder signal P. When the encoder means comprises a disc with a plurality of spaced markings, which are sensed by a first optical sensor, thereby producing pulses that are indicative of web displacement, the signal I is generated by means of a second optical sensor, so that for every revolution of the encoder disc, a single pulse is generated. As such the encoder pulse counter 210 identifies, using the index pulse as a reference, by means of a multi-bit signal, each pulse P produced by the first optical sensor. In the encoder correction table 212, which is preferably contained in some form of non-volatile memory such as a programmable read-only memory (PROM), are stored predetermined multi-bit period time correction values for each of the individual encoder pulses P. In order to allow the encoder correction means to decrease the period time of a certain pulse, such period time correction values are the sum of a positive fixed time and a positive or negative corrective time. Delay means 214 will delay every pulse output from the first encoder sensor by a time equal to the predetermined correction time received from the encoder correction table 212 thus producing a corrected encoder signal $f_s$.

In FIG. 14 there is shown a multi-station multi-colour printer for the simplex printing of sheet material. The printer has five image transferring stations A to E. These have the form as previously described. However, in place of a web of paper passing the image transfer stations there is provided a continuous belt 115 of an electrically insulating material with good dielectric properties such as polyethylene terephthalate, polytetrafluoroethylene (eg Teflon—Trade Mark), polyimide (eg Kapton—Trade Mark) or silicone rubber. The belt 115 is driven by a lower driver roller 116 provided with an encoder 119, and passes over an upper roller 112. The belt 115 is contained within a tower-like support column 146. Each station A to E is mounted in a substantially horizontal orientation.

As the belt 115 passes the stations A to E a multi-colour in-register toner image is formed thereon in the same way as described previously in connection with the paper web 12 (see FIG. 3). However, the belt 115 does not pass through an image-fixing station. In the embodiment of FIG. 14 after leaving the last printing station E the belt passes to a total image transfer station 122 where a corona discharge unit causes transfer of the total image from the belt 115 to a sheet 118 of paper extracted from a stack 123 of such sheets. The sheets of paper 118 are fed from the stack 123 by a feeding device generally represented by reference 117, known in the art. Each sheet is conveyed through the printer by way of drive rollers 125 and drive belts 124, 126 and ultimately to a stacker 120. After having the total image transferred thereon at the transfer station 122, each sheet of paper passes through the hot roller fixer 121 where the image is fixed onto the paper sheet. After passing the transfer station 122, the belt 115 passes a belt cleaning station 130 where residual toner is removed, leaving the surface of the belt clean for receipt of a further toner image.

In the embodiment shown in FIG. 15 many features are similar to those found in FIG. 14. In the case of FIG. 15, the belt 115 passes over two upper rollers 112 and 112', each associated with a total image transfer station 122 and 122'. Sheets of paper 118 are fed from the stack 123 to the first transfer station 122 where a first image on the belt 115 is transferred to one side of the paper sheet and thereafter via an intermediate hot roller fusing station defined by reversible driven rollers 131 and 132 to a holding conveyor 124'. By reversing the conveyor 124' and the rollers 131 and 132 the sheet of paper 118 is reversed and passed to a second image transfer station 122' where a second image on the belt 115 is transferred to the opposite side of the paper sheet before being fed to the final fixer 121 and the stacker 120.

In the embodiment shown in FIG. 16 a duplex printer is shown comprising two support columns 146 and 146' each housing imaging stations A to D and last printing station E and A' to D' and E' respectively. One image, destined for printing on one side of a paper sheet 118, is transferred by stations A to E to the belt 115 and from there to the paper sheet 118 at the total image transfer station 122. Thereafter the paper sheet 118, having an image printed on one side thereof is conveyed by means of rollers 131 and 132 to a holding conveyor 124'. By pivoting and reversing the conveyor 124', the paper sheet 118 is now fed between rollers 132 and 131' and passed to a second image transfer station 122'. This arrangement avoids the use of reversible driven rollers such as are used in the printer shown in FIG. 15. At the second total image transfer station 122' the second image, which has been transferred by stations A' to E' to the belt 115' is transferred therefrom to the other side of the paper sheet before the latter is fed to the fixer 121 and stacker 120.

Those skilled in the art will appreciate that other sheet reversal mechanisms could equally well be utilized in printers such as those shown in FIGS. 15 and 16.

FIGS. 17A to 17E show a number of different arrangements of printing stations A to D and A' to D' relative to the path of the web 12. The operation of these arrangements will be clear to those skilled in the art. The stations may be arranged in horizontal, vertical or other configurations.

CROSS-REFERENCE TO CO-PENDING APPLICATIONS

A number of features of the printers described herein are the subject matter of the following co-pending U.S. patent application Ser. Nos.: 08/257,116 entitled "ELECTROSTATOGRAPHIC SINGLE-PASS MULTIPLE STATION PRINTER FOR DUPLEX PRINTING,"; 08/257,111 entitled "ELECTROSTATOGRAPHIC SINGLE-PASS MULTIPLE STATION PRINTER WITH REGISTER CONTROL,"; 08/257,046 entitled "PAPER RECEPTOR MATERIAL CONDITIONING APPARATUS,"; and 08/257,048 entitled "ELECTROSTATOGRAPHIC PRINTER FOR FORMING AN IMAGE ONTO A RECEPTOR ELEMENT," all filed Jun. 8, 1994.

What is claimed is:

1. An electrostatographic single-pass multiple station printer for forming an image onto a web, which comprises:

a plurality of toner image-producing electrostatographic stations each having rotatable endless surface means onto which a toner image can be formed;

means for conveying the web in succession past said stations;

means for controlling the speed and tension of the web while it is running past said stations;

guiding means which determine the web wrapping angle about the rotatable surface means;

transfer means for transferring the toner image on each rotatable surface means onto the web, wherein in said printer adherent contact of said web with said rotatable endless surface means is such that the movement of said web controls the peripheral speed of said surface means in synchronism with the movement of said web.

2. A printer according to claim 1, wherein said guiding means comprise guide roller means.

3. A printer according to claim 1, wherein said transfer means is a corona discharge device providing electrostatic adhesion between the web and the endless surface means.

4. A printer according to claim 1, wherein the web is a final support for the toner images and is unwound from a roll, image-fixing means being provided for fixing the transferred toner images on the web.

5. A printer according to claim 4, which further comprises a roll stand for unwinding a roll of web to be printed in the printer, and a web cutter for cutting the printed web into sheets.

6. A printer according to claim 1, wherein the web is a temporary support in the form of an endless belt, and wherein the printer further comprises transfer means for transferring the images formed on the belt onto a final support, image-fixing means being provided for fixing the transferred images on the final support.

7. A printer according to claim 6, wherein the final support is in sheet form.

8. A printer according to claim 1, wherein each endless surface means comprises a photoconductive surface and each image-producing station further comprises:

means for charging said endless surface means;

means for forming an electrostatic latent image on said endless surface means; and a development station for depositing toner onto the electrostatic latent image.

9. A printer according to claim 8, wherein the means for charging the endless surface means at each image-producing station is capable of charging each endless surface means to the same polarity.

10. A printer according to claim 1, wherein each image-producing station comprises a driven rotatable magnetic developing brush and a driven rotatable cleaning brush, both in frictional contact with the endless surface means, said brushes rotating in mutually opposite directions.

11. A printer according to claim 10, wherein the extents of frictional contact of the developing brush and the cleaning brush with said endless surface means are such that the resultant torque transmitted to the endless surface means is substantially zero.

12. A printer according to claim 10, wherein the position of at least one of said brushes relative to said endless rotatable surface means is adjustable thereby to adjust the extent of frictional contact between that brush and said endless surface means.

13. A printer according to claim 1, wherein the endless surface means is formed by the circumferential surface of a drum.

14. A printer according to claim 1, wherein said image-producing stations are arranged in two sub-groups that are passed in succession by the moving web, one sub-group forming an image on one web side and the other sub-group forming an image on the other web side, thereby to enable sequential duplex printing.

15. A printer according to claim 14, which further comprises at least one idler roller for reversing the direction of web travel between the sub-groups.

16. A printer according to claim 1, wherein said image-producing stations are arranged in two sub-groups, the rotatable surface means of one sub-group forming guide roller means for the other sub-group, and vice-versa, thereby to enable simultaneous duplex printing.

17. A printer according to claim 14, wherein said image-producing stations of the sub-groups are arranged in substantially mutually parallel configuration.

18. A printer according to claim 17, wherein said image-producing stations of each sub-group are arranged in a substantially vertical configuration.

19. A printer according to claim 1, which is a colour printer comprising cyan, yellow, magenta and black printing stations.

20. A printer according to claim 1, wherein said wrapping angle is at least 5°.

21. A printer according to claim 1, further comprising a rotatable contact roller for contacting the web while it has an electrostatically charged toner particle image on at least that surface thereof which is adjacent said contact roller, wherein said contact roller is associated with electrostatic charging means capable of providing on the surface of said contact roller an electrostatic charge having the same polarity as the charge polarity of the toner particles on the adjacent surface of said web before contact of said web with the surface of said contact roller.

* * * * *

UNITED STATES PATENT AND TRADEMARK OFFICE

CERTIFICATE OF CORRECTION

PATENT NO. : 5,455,668

DATED : October 3, 1995

INVENTOR(S) : De Bock et al.

It is certified that error appears in the above-indentified patent and that said Letters Patent is hereby corrected as shown below:

First page, Item [30], last line, "May 4" should read --Apr. 5--;

Column 6, line 57, "FIG. 7" should read --FIG. 7. FIGS. 8-1, 8-2, 8-3 and 8-4 are enlargements of different parts of the portion of the printer shown in FIG. 8.--;

Column 6, line 62, "A-2" should read --7A-2--;

Column 14, line 50, "$C_1$" should read --$C_2$--;

Column 15, line 20, "$l_{AB} = \int_0^{t_{AB}} vdt.$" should read $$-- l'_{AB} = \int_0^{t_{AB}} vdt. --$$

Column 15, line 27, "$f_z$" should read --$f_E$--.

Signed and Sealed this

Eighteenth Day of June, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,455,668

DATED : October 3, 1995

INVENTOR(S) : De Bock et al.

It is certified that error appears in the above-indentified patent and that said Letters Patent is hereby corrected as shown below:

Title page, Item [30], last line, "May 4" should read --Apr. 5--;

Column 6, line 57, "FIG. 7" should read --FIG. 7. FIGS. 8-1, 8-2, 8-3 and 8-4 are enlargements of different parts of the portion of the printer shown in FIG. 8.--;

Column 6, line 62, "A-2" should read --7A-2--;

Column 14, line 50, "$C_1$" should read --$C_2$--;

Column 15, line 20, "$l'_{AB} = \int_0^{t_{AB}} v dt$" should read $$-- l'_{AB} = \int_0^{t_{AB}} v dt. --$$

Column 15, line 27, "$f_z$" should read --$f_E$--.

This certificate supersedes Certificate of Correction issued June 18, 1996.

Signed and Sealed this

Third Day of December, 1996

Attest:

Bruce Lehman

BRUCE LEHMAN

Attesting Officer

Commissioner of Patents and Trademarks